US012385241B2

(12) United States Patent
Ritter et al.

(10) Patent No.: US 12,385,241 B2
(45) Date of Patent: Aug. 12, 2025

(54) DRAIN SYSTEM FOR BATHTUB

(71) Applicant: Kohler Co., Kohler, WI (US)

(72) Inventors: David H. Ritter, Kohler, WI (US); Brian S. Core, Fond du Lac, WI (US); Douglas J. Brouwer, Sheboygan, WI (US); Keith S. Ruh, Elkhart Lake, WI (US); Autumn-Storm Antoinette McFaul, Mequon, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 18/233,829

(22) Filed: Aug. 14, 2023

(65) Prior Publication Data

US 2023/0383510 A1 Nov. 30, 2023

Related U.S. Application Data

(63) Continuation of application No. 17/117,325, filed on Dec. 10, 2020, now Pat. No. 11,725,373.

(60) Provisional application No. 62/948,233, filed on Dec. 14, 2019.

(51) Int. Cl.

| | |
|---|---|
| ***E03C 1/242*** | (2006.01) |
| ***E03C 1/232*** | (2006.01) |
| ***E03C 1/24*** | (2006.01) |

(52) U.S. Cl.

CPC ..... *E03C 1/242* (2013.01); *E03C 1/232* (2013.01); *E03C 2001/2413* (2013.01)

(58) Field of Classification Search

CPC . E03C 1/232; E03C 1/22; E03C 1/242; E03C 2001/2413

See application file for complete search history.

(56) References Cited

U.S. PATENT DOCUMENTS

| | | | |
|---|---|---|---|
| 1,704,510 | A | 3/1929 | Muend |
| 1,737,804 | A | 12/1929 | Reedy |
| 1,781,325 | A | 11/1930 | Dowling |
| 1,821,584 | A | 9/1931 | Schultis |
| 1,943,628 | A | 1/1934 | Schultis |
| 3,064,094 | A | 11/1962 | Marchi |

(Continued)

FOREIGN PATENT DOCUMENTS

| | | | |
|---|---|---|---|
| CN | 102230320 | A | 11/2011 |
| CN | 202173317 | U | 3/2012 |

(Continued)

OTHER PUBLICATIONS

Extended European Search Report on EP Appl. No. 20213487.0 dated May 20, 2021 (10 pages).

(Continued)

*Primary Examiner* — Janie M Loeppke

(74) *Attorney, Agent, or Firm* — FOLEY & LARDNER LLP

(57) ABSTRACT

A drain system for controlling a water level in a bathtub includes a drain exit assembly coupled to an exit drain of the bathtub and configured to receive water exiting the bathtub, a valve fluidly coupled to the drain exit assembly and operably coupled to a motor, and a pressure sensor communicatively coupled to the valve and in fluid communication with the drain exit assembly. The motor is configured to change the operational state of the valve based on a pressure sensed by the pressure sensor to control a water level within the bathtub.

13 Claims, 36 Drawing Sheets

(56) References Cited

U.S. PATENT DOCUMENTS

| | | | | |
|---|---|---|---|---|
| 3,156,931 | A | 11/1964 | Holtman | |
| 3,159,849 | A | 12/1964 | Jacuzzi | |
| 3,591,872 | A | 7/1971 | Vanegas et al. | |
| 3,860,977 | A | 1/1975 | Politz | |
| 4,468,938 | A | 9/1984 | McMillan | |
| 4,700,884 | A | 10/1987 | Barrett et al. | |
| 4,852,054 | A | 7/1989 | Mastandrea | |
| 4,930,164 | A * | 6/1990 | Gibson | E03C 1/22 4/683 |
| 5,079,784 | A | 1/1992 | Rist et al. | |
| 5,121,509 | A * | 6/1992 | Juple | E03C 1/232 4/686 |
| 5,207,251 | A | 5/1993 | Cooks | |
| 5,210,886 | A | 5/1993 | Coe, III | |
| 5,333,498 | A | 8/1994 | Brackett et al. | |
| 6,058,525 | A | 5/2000 | Paden | |
| 6,142,017 | A * | 11/2000 | Glassey | G01F 23/16 73/299 |
| 6,473,917 | B1 | 11/2002 | Mateina | |
| 6,497,143 | B1 | 12/2002 | Rinkewich | |
| 6,732,388 | B2 | 5/2004 | McKenna | |
| 6,895,610 | B2 | 5/2005 | Olson | |
| 7,007,319 | B2 | 3/2006 | Dunnett et al. | |
| 7,076,814 | B2 | 7/2006 | Ostrowski et al. | |
| 7,451,502 | B2 | 11/2008 | Ball | |
| 7,631,522 | B2 | 12/2009 | Bindocci et al. | |
| 7,658,104 | B2 | 2/2010 | Hewitt | |
| 7,913,331 | B2 | 3/2011 | Hartman | |
| 8,505,139 | B2 | 8/2013 | Vanhazebrouck et al. | |
| 9,096,966 | B2 | 8/2015 | Kaltofen | |
| 9,816,258 | B2 | 11/2017 | Marotz et al. | |
| 10,760,250 | B2 | 9/2020 | Ewers | |
| 10,774,510 | B2 * | 9/2020 | Braddock | E03C 1/242 |
| 11,064,844 | B2 | 7/2021 | Braddock et al. | |
| 11,085,178 | B1 | 8/2021 | Oliver | |
| 11,169,548 | B2 | 11/2021 | Shaaban et al. | |
| 11,725,373 | B2 * | 8/2023 | Ritter | E03C 1/242 4/668 |
| 2005/0028295 | A1 | 2/2005 | Jeon et al. | |
| 2008/0047060 | A1 | 2/2008 | Ball | |
| 2008/0163416 | A1 | 7/2008 | Go | |
| 2009/0050209 | A1 | 2/2009 | Rautavuori | |
| 2009/0178192 | A1 | 7/2009 | Vassilev | |
| 2013/0175350 | A1 | 7/2013 | Marks | |
| 2014/0174547 | A1 | 6/2014 | Joo | |
| 2014/0359935 | A1 | 12/2014 | Veros et al. | |
| 2015/0122337 | A1 * | 5/2015 | Manavoglu | E03C 1/232 137/151 |
| 2015/0227145 | A1 | 8/2015 | Reddy et al. | |
| 2015/0240464 | A1 | 8/2015 | Meyers | |
| 2016/0177554 | A1 | 6/2016 | Yu | |
| 2016/0186418 | A1 | 6/2016 | Yu | |
| 2017/0342629 | A1 | 11/2017 | Gwon et al. | |
| 2018/0310775 | A1 | 11/2018 | Degraye et al. | |
| 2018/0364743 | A1 * | 12/2018 | Limberg | E03C 1/232 |
| 2019/0331252 | A1 * | 10/2019 | Jensen | G05D 9/12 |
| 2020/0033898 | A1 | 1/2020 | Shaaban et al. | |
| 2021/0180304 | A1 | 6/2021 | Ritter et al. | |

FOREIGN PATENT DOCUMENTS

| | | | |
|---|---|---|---|
| CN | 206037430 | U | 3/2017 |
| CN | 106802176 | A | 6/2017 |
| DE | 39 25 590 | A1 | 2/1991 |
| EP | 0 174 53 | A1 | 3/1980 |
| EP | 2 918 739 | A1 | 9/2015 |
| FR | 2704882 | | 11/1994 |

OTHER PUBLICATIONS

First Chinese Office Action for CN Appl. Ser. No. 201910654352.1 dated Aug. 17, 2020 (18 pages) (English Translation).

First Chinese Office Action on CN Appl. Ser. No. 202011470989.4 dated Mar. 29, 2022 (20 pages).

Machine English Translation of DE3925590A1 (2021).

Salesa, Yuyan, "What is the name of the unit that controls the flow and temperature of the bathtub?", Askinglot.com, 2020, Retrieved from https://askinglot.com/what-is-the-name-of-the-unit-that-controls-the-flow-and-temperature-of-the-bathtub on Jan. 4, 2022 (3 pages).

Second Chinese Office Action issued in connection with CN Appl. Ser. No. 202011470989.4 dated Sep. 28, 2022 (10 pages).

Second Office Action issued in connection with CN Appl. No. 201910654352.1 dated Jun. 3, 2021 (18 pages).

* cited by examiner

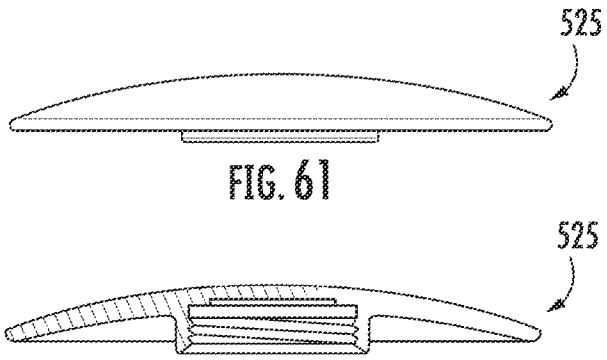
FIG. 61
FIG. 62
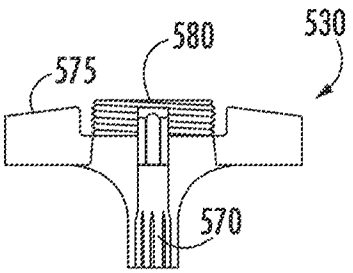
FIG. 64
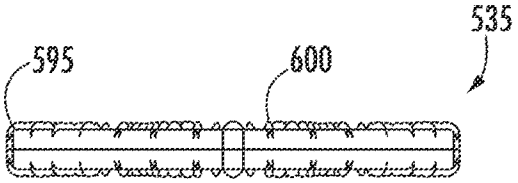
FIG. 66
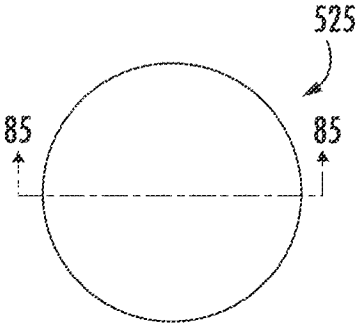
FIG. 60
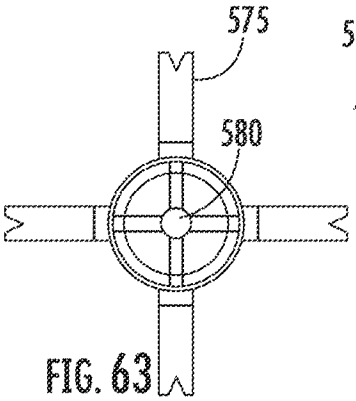
FIG. 63
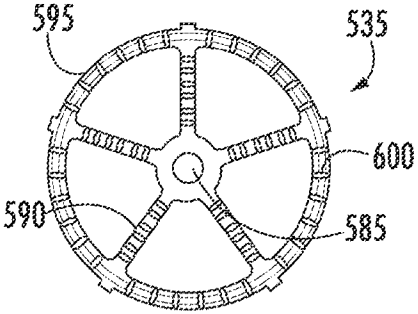
FIG. 65
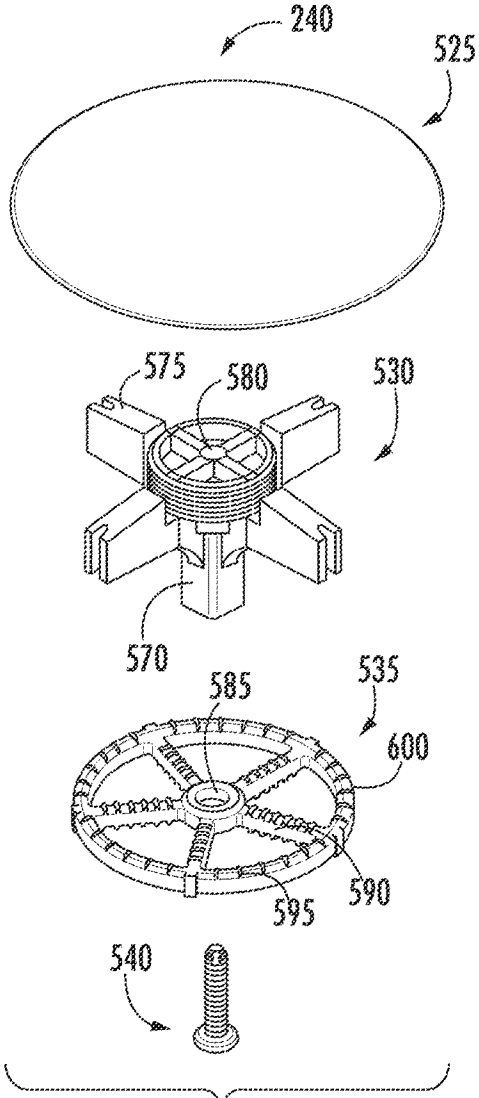
FIG. 59

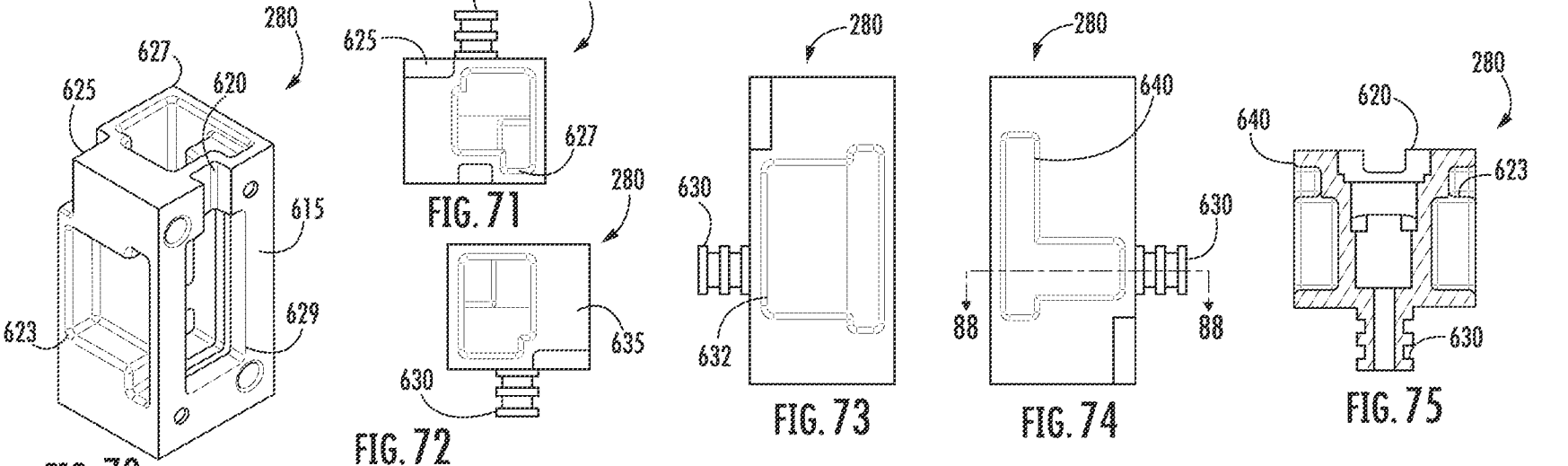
FIG. 75
FIG. 74
FIG. 73
FIG. 71
FIG. 72
FIG. 70
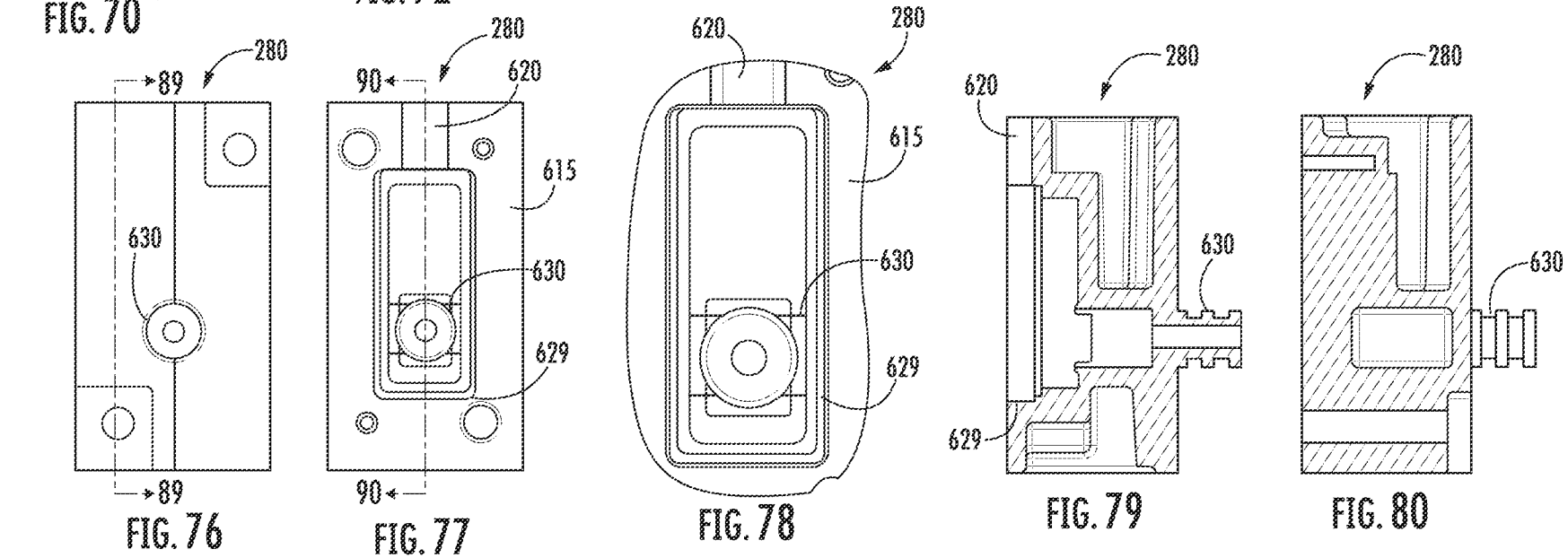
FIG. 80
FIG. 79
FIG. 78
FIG. 77
FIG. 76

DRAIN SYSTEM FOR BATHTUB

CROSS-REFERENCE TO RELATED PATENT APPLICATIONS

This application is a continuation of U.S. patent application Ser. No. 17/117,325, filed on Dec. 10, 2020, which claims the benefit and priority to U.S. Provisional Application No. 62/948,233, filed Dec. 14, 2019, the entire disclosure of which is hereby incorporated by reference herein.

BACKGROUND

The present disclosure relates generally to systems used in a bath or shower environment to improve a user's bathing experience. More specifically, the present disclosure relates to controlling water flow through bathtub exit and overflow drains.

Bathtub fill and drain features are often asynchronous, requiring separate operation of fill and drain features. In addition, bathtub fill and drainage systems are often specific to a particular bathtub design and have specific installation requirements.

It would be advantageous to provide a versatile fill and drainage system for a bathtub that can coordinate, control, and monitor bathtub filling and drainage to ensure a best possible experience by a user.

SUMMARY

At least one embodiment of this application relates to a system for controlling a water level in a bathtub, which includes a drain exit assembly coupled to an exit drain of the bathtub, a valve fluidly coupled to the drain exit assembly, the valve being operably coupled to a motor, wherein the motor is configured to change an operational state of the valve, a pressure sensor communicatively coupled to the valve and in fluid communication with the drain exit assembly. The drain exit assembly is configured to receive water exiting the bathtub and the motor is configured to change the operational state of the valve based on a pressure sensed by the pressure sensor to control a water level within the bathtub.

In various embodiments, the valve is a paddle valve. In other embodiments, the valve is a butterfly valve. In some embodiments, the valve is coupled to an inlet valve body, the inlet valve body coupled to a housing, wherein the pressure sensor is disposed within the housing. The inlet valve body may include an air pocket, wherein the pressure sensed by the pressure sensor associated with the air pocket. In some embodiments, the system further includes a thermistor communicatively coupled to the valve and in fluid communication with the drain exit assembly. In various embodiments, the motor is further configured to change the operational state of the valve based on a temperature measured by the thermistor.

In various embodiments, the system also includes an overflow drain assembly, the overflow drain assembly configured to receive water from an overflow drain of the bathtub. The overflow drain assembly may be configured for coupling to an overflow drain cover. In various embodiments, the overflow drain assembly is fluidly coupled to the drain exit assembly downstream of the valve. In some embodiments, the motor is configured change the operational state of the valve based on one or more routines, the one or more routines being set by a user device. In various embodiments, the system may include one or more fluid coupling components, wherein the one or more fluid coupling components are sizable to accommodate at least one of a bathtub size or type. The system may further include an outlet valve body fluidly coupled to the valve, wherein the outlet valve body is configured to receive water flowing from the valve and direct the water away from the bathtub. The outlet valve body may be configured to direct the water in a downward direction relative to the bathtub. In other embodiments, the outlet valve body may be configured to direct the water in a horizontal direction relative to the bathtub. The outlet valve body may include one or more contoured features to facilitate quiet water flow therethrough. In various embodiments, the pressure indicates at least one of the water level or an occupancy of the bathtub.

According to another aspect of this application relates to a method for controlling a water level in a bathtub, wherein the method includes receiving, by a drain exit assembly, water exiting the bathtub, wherein the drain exit assembly is coupled to an exit drain of the bathtub. The method further includes sensing, by a pressure sensor, a pressure associated with an inlet valve body coupled to a valve, wherein the valve is fluidly coupled to the drain exit assembly, and changing, by a motor, an operational state of the valve responsive to the pressure sensor sensing the pressure, wherein the pressure sensor is in fluid communication with the drain exit assembly and operatively coupled to the valve. In various embodiments, the method further includes receiving, by the motor, an input from a user device, wherein the input comprises instructions associated with at least one of setting the water level or a temperature of water within the bathtub.

Yet another aspect of this application relates to a bathtub drain system, wherein the system includes a bathtub configured to receive water and having a first drain and a second drain, and a drain exit assembly fluidly coupled to the first drain, an overflow drain assembly fluidly coupled to the second drain. The drain exit assembly may be to receive water flowing through the first drain and the overflow drain assembly may be configured to receive water flowing through the first drain. The overflow drain assembly is fluidly connected to the drain exit assembly downstream of a valve coupled to the drain exit assembly. The valve is controlled by a motor and fluidly coupled with a pressure sensor, wherein the pressure sensor is configured to sense a pressure associated with a water level in the bathtub. The motor may be configured to change an operational state of the valve responsive to the pressure sensed by the pressure sensor.

BRIEF DESCRIPTION OF THE FIGURES

FIG. 59 shows an exploded view of a drain cover assembly of the drain system of FIG. 54, according to an exemplary embodiment.

FIG. 60 shows a top view of a drain stopper of the drain cover assembly of FIG. 59, according to an exemplary embodiment.

FIG. 61 shows a side view of the drain stopper of FIG. 60, according to an exemplary embodiment.

FIG. 62 shows a side cross-sectional view of the drain stopper of FIG. 60 taken along line of FIG. 60, according to an exemplary embodiment.

FIG. 63 shows a top view of a drain post of the drain cover assembly of FIG. 59, according to an exemplary embodiment.

FIG. 64 shows a side view of the drain post of FIG. 63, according to an exemplary embodiment.

FIG. 65 shows a top view of a drain strainer of the drain cover assembly of FIG. 59, according to an exemplary embodiment.

FIG. 66 shows a side view of the drain strainer of FIG. 65, according to an exemplary embodiment.

FIG. 70 shows a perspective view of a pressure sensor mounting block of the drain system of FIG. 67, according to an exemplary embodiment.

FIG. 71 shows a bottom view of the pressure sensor mounting block of FIG. 70, according to an exemplary embodiment.

FIG. 72 shows a top view of the pressure sensor mounting block of FIG. 70, according to an exemplary embodiment.

FIGS. 73-74 show side views of the pressure sensor mounting block of FIG. 70, according to exemplary embodiments.

FIG. 75 is a bottom cross-section of the pressure sensor mounting block of FIG. 70 taken along line 88-88 of FIG. 74, according to an exemplary embodiment.

FIG. 76 shows a back view of the pressure sensor mounting block of FIG. 70, according to an exemplary embodiment.

FIG. 77 shows a front view of the pressure sensor mounting block of FIG. 70, according to an exemplary embodiment.

FIG. 78 is a reproduction of FIG. 77, near cutout features, according to exemplary embodiments.

FIG. 79 shows a side cross-sectional view of the pressure sensor mounting block of FIG. taken along line 89-89 of FIG. 76, according to an exemplary embodiment FIG. 80 shows a side cross-sectional view of the pressure sensor mounting block of FIG. taken along line 90-90 of FIG. 77, according to an exemplary embodiment.

FIG. 124 is a top view representation of an existing power supply for a drain system, according to an exemplary embodiment.

FIG. 125 is a perspective view of the power supply of FIG. 124.

FIG. 126 is a side view of the power supply of FIG. 124.

FIG. 127 shows a controller for a drain system, according to an exemplary embodiment.

DETAILED DESCRIPTION

Figure 1:
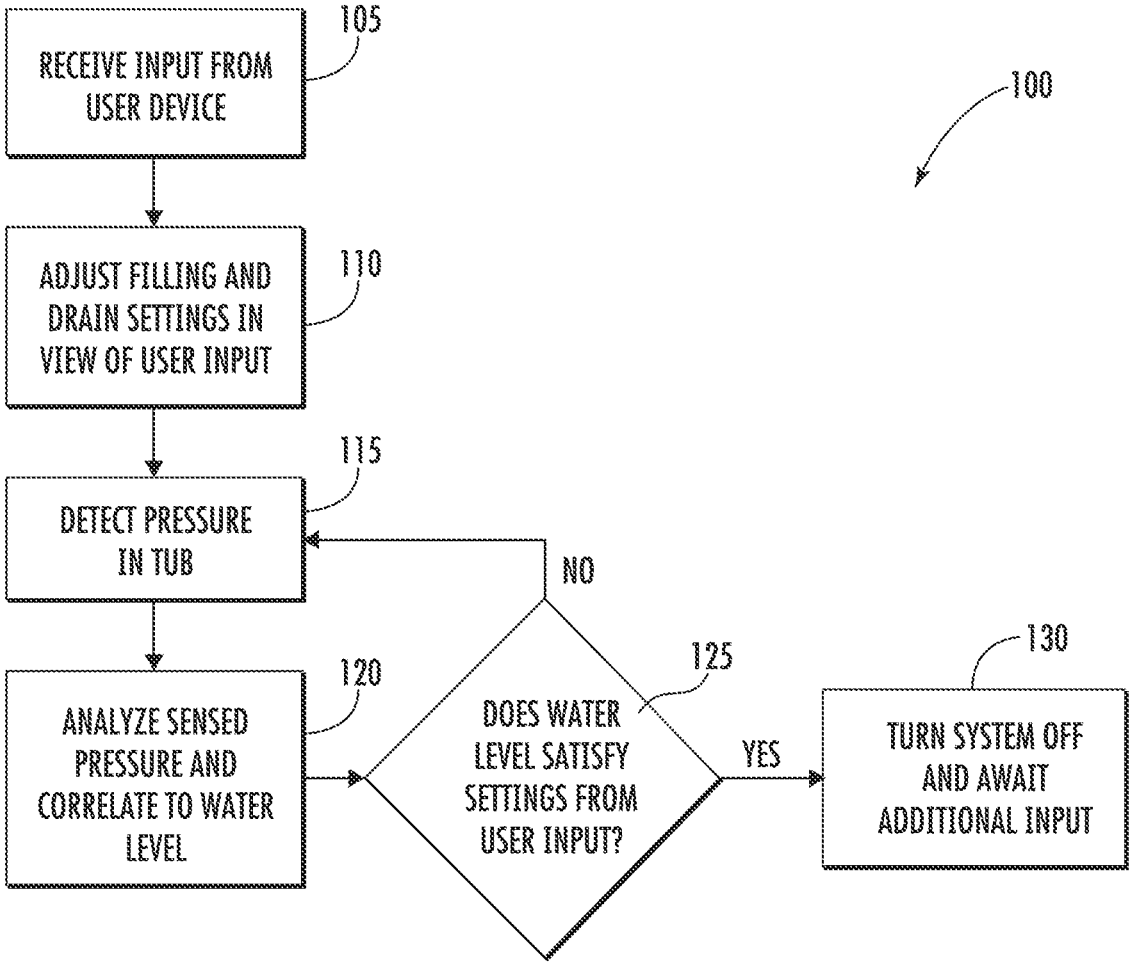
FIG. 1 is a flow diagram illustrating operations performed by a drain system, according to an exemplary embodiment.

One embodiment of the present disclosure is a drain system that includes an overflow drain assembly coupled with a mechanical valve that is housed within a modular assembly to electronically control water flow through a bathtub exit drain. The system includes an exit drain assembly installed within the bathtub water outlet, which is coupled to a valve assembly to meter flow of the water exiting the bathtub. The valve assembly includes a valve that may be rotated about an axis at various angles to meter water flow exiting the bathtub. The valve assembly further includes a motor to actuate the valve. Operation of the valve is dependent on input received from sensors coupled to the valve assembly and input from one or more user devices. The one or more sensors are contained within a housing mechanically coupled to the valve assembly.

In some embodiments, the valve assembly of the drain system is fluidly coupled to the overflow drain assembly at the valve assembly outlet such that water outlets from the overflow assembly and the bath exit drain assembly are conjoined. The entire drain system is constructed via pipes, screws, swivel joints, adapters, and other common plumbing implementations that can be modified, interchanged, and/or customized to accommodate a wide variety of bathtub designs.

In other embodiments, the drain system includes one or more temperature sensors to enable temperature monitoring to inform fill and drain features. In some embodiments, the drain system includes one or more component options to adapt the system for installation in a wide variety of environments and/or to a wide variety of bathtub designs.

Referring generally to the figures, a drain system includes an overflow drain assembly coupled with a mechanical valve that is housed within a modular assembly to electronically control water flow through a bathtub exit drain. The system includes an exit drain assembly installed within the bathtub water outlet, which is coupled to a valve assembly to meter flow of the water exiting the bathtub. The valve assembly includes a valve that may be rotated about an axis at various angles to meter water flow exiting the bathtub. The valve assembly further includes a motor to actuate the valve. Operation of the valve is dependent on input received from sensors coupled to the valve assembly and input from one or more user devices. The one or more sensors are contained within a housing mechanically coupled to the valve assembly. The sensors may include pressure sensors and/or thermostatic sensors. The valve assembly is fluidly coupled to the overflow drain assembly at the valve assembly outlet such that water outlets from the overflow assembly and the bath exit drain assembly are conjoined. The entire drain system is constructed via pipes, screws, swivel joints, adapters, and other common plumbing implementations that can be modified, interchanged, and/or customized to accommodate a wide variety of bathtub designs. The drain system can facilitate controlled filling and draining of a bathtub, enable the control of water level and temperature maintenance, and adjust for occupancy.

In some implementations, the system is digitally controlled via one or more user interfaces, computer and/or smart device applications, cloud-based voice command systems, or any other suitable method for receiving input. In various implementations, the one or more user interfaces may be coupled to the system remotely or locally.

In some implementations, the system may be adapted to fit a multitude of bathtub designs that may or may not include an overflow exit drain in addition to a primary bathtub exit drain. For designs requiring an overflow exit drain, the system may be adapted to accommodate various overflow drain opening geometries.

In various implementations, the system can be configured for installation in various types of dwelling or framing conditions surrounding a bathtub. These conditions may include plumbing and drainage implementations above or below flooring, or in front of or behind adjacent structural framework (e.g. walls, studs, etc.).

In various implementations, the system includes adjustable components such as swivel joints, adapter/extension pipes, and outward-facing accessible screw fittings. These adjustable components may be included within the exit drain assembly, the valve assembly, the overflow drain assembly, or any fluidly or mechanically segments to the aforementioned assemblies.

In various implementations, the system includes components that can be interchanged for aesthetic purposes, such as an overflow cover assembly coupled to the overflow drain assembly. In various embodiments, overflow cover assemblies may be different shapes such as flat or tray-shaped, round, or a combination thereof. In various exemplary embodiments, the overflow cover assemblies may include components that facilitate ease of installation and adaptation to a multitude of bathtub designs.

In various exemplary embodiments, the system is configured to monitor the water level within a bathtub by measuring the pressure on an air pocket within an air passageway adjacent to a pressure sensor coupled to valve assembly. In various exemplary embodiments, the system is configured to determine the water level within a bathtub independent of the shape of the bathtub via a pressure measurement by the pressure sensor.

In various exemplary embodiments, the system is configured to provide a multitude of various functional capabilities beyond water level determination such as recognizing bathtub occupancy, operating based on preferences input by a user device, and providing digital information for data analytics that may be accessible by a user and/or user device (e.g. water usage, in-bath changes, trends, etc.).

In other exemplary embodiments, the system may have features that preserve the operation of the system over time, including moderating external pressure exposure (e.g. plunging) or pressure resulting from water drainage, to pressure-sensitive components (e.g. pressure sensor). In other exemplary embodiments, the system may include features that enable manual manipulation of components to allow operation without electronic control. In other exemplary embodiments, the system may include implementations for preventing debris within the bathtub from exiting into the system. Such implementations may include a debris strainer and drain exit cover over the bathtub water outlet.

In various exemplary embodiments, the system is configured to provide various safety or comfort features to a user of the bathtub attached system. In various embodiments, the valve may have limited runtime wherein the valve is only in an open or closed position for a preset period of time. The system may also be configured to adjust the valve opening such that water exiting the bathtub is not turbulent and produces minimal sound. In other embodiments, the system may be configured to have various calibration settings to ensure accurate filling, draining, and monitoring of a coupled bathtub. In yet other exemplary embodiments, the system may be configured to monitor the rate of change of sensed pressure to determine normal or abnormal filling, drainage, or bathtub occupancy. In various exemplary embodiments, a control of the drain system may enable the selective shut down or mode change of a system depending on predefined manufacturer error codes and/or user-device specified rules.

In various exemplary embodiments, the system may be configured to operate based on preset routines in response to input from a user device. Preset routines may be set by the user device and may include routines to sequentially or cyclically fill and/or drain water from a bathtub coupled to the system. Preset routines may operate based on a user device-determined point in time or according to a preset schedule defined by the user device. In various exemplary embodiments, such routines may include one or more purge cycle routines, whereby the system facilitates scheduled cleaning of the coupled bathtub.

In various exemplary embodiments, the system is configured to accommodate one or more predefined settings determined or set by a user device. The predefined settings may cause an increase or decrease in temperature of bath water, resulting from a system-initiated change in temperature and flow of water into and out of the bathtub. The settings may also cause the system alter the level of water within the bathtub, including filling or draining to preset amounts.

In various exemplary embodiments, the system may include an electronically coupled thermistor to measure and precisely control the temperature of water entering, exiting, or remaining within a bathtub. In various embodiments, the thermistor-containing system may facilitate the determination and setting of water temperature preferences within the bathtub, as defined or input by a user device. In various exemplary embodiments, the system may include a flow meter device coupled to water flow passageways located between the bathtub exit drain and the mechanical valve. In various embodiments, the device-containing system may monitor the amount and speed of water entering the system via the bathtub exit drain and, consequently, facilitate the determination and setting of desired water flow characteristics (e.g. drainage rates). The system may also be configured to provide digital information, such as to a user device, for the purposes of data analytics (e.g. temperature preferences, decay, trends, etc.). Digital information may be sourced from a thermistor, pressure sensor, flow meter device, or any other measuring implement mechanically or communicably coupled to the system.

In various implementations, the system may be configured to operate with various types of valve designs. In various exemplary embodiments, the system may include a gate or paddle-shaped valve which rotates about an attachment point located on one end of the valve. In alternative exemplary embodiments the system may include a butterfly valve with a central attachment point to facilitate equal pressure on valve surfaces and driving motor components. In various exemplary embodiments, the system may be configured to implement a particular valve design to accommodate requirements of a coupled motor (e.g. size, cost, etc.).

In various exemplary embodiments, components of the system may be configured to increase drain capacity and facilitate smooth and efficient water flow therein. Such configurations may include geometric features within the components to alter direction and velocity of water flow. In various exemplary embodiments, components included within the valve assembly may constructed to include features that reduces debris collection and promote a smooth flow geometry.

Turning now to the accompanying figures, and referring specifically to FIG. 1, a method 100 for operation of a drain system is shown according to an exemplary embodiment. In operation 105, the system receives input from a user device (local or remote) that pertains to the filling and/or draining of a bathtub coupled to the system (e.g. a desired water fill level), and subsequently adjusts filling and drain settings to accommodate the received input in operation 110. The user device may communicate with the system via wired connections (e.g. Ethernet, USB, etc.) or wireless connections (e.g. Bluetooth, WiFi, NFC, etc.). According to one exemplary embodiment, input may be received from a user device (e.g. smart device, coupled user interface) at a controller or receiver.

The system detects and monitors pressure within the bathtub in operation 115, which can be related to a water level and/or occupancy within the bathtub in operation 120. The system can then determine if the water level satisfies the received user device input in operation 125. If the determined water level is satisfies the conditions of the user device input received in operation 105, the system can turn off or otherwise switch settings and/or modes and await further input from the user device (operation 130). If the system determines that the water level does not satisfy the user device input that was received in operation 105, the system can reiterate through operations 115, 120, and 125 until the user device input conditions are met.

Figure 2:
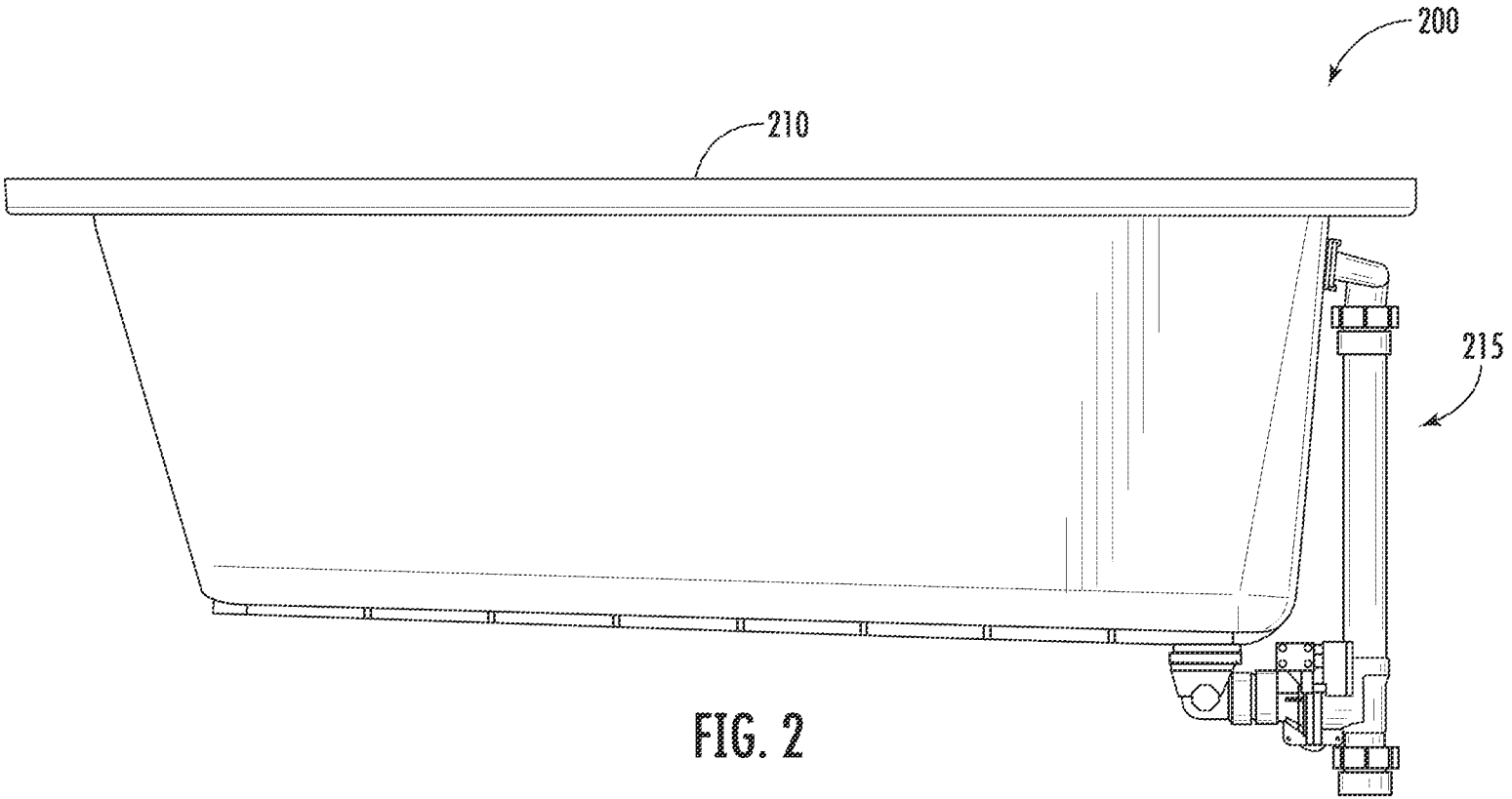
FIG. 2 is a side view of the drain system of FIG. 1 attached to a bathtub, according to an exemplary embodiment.
Figure 4:
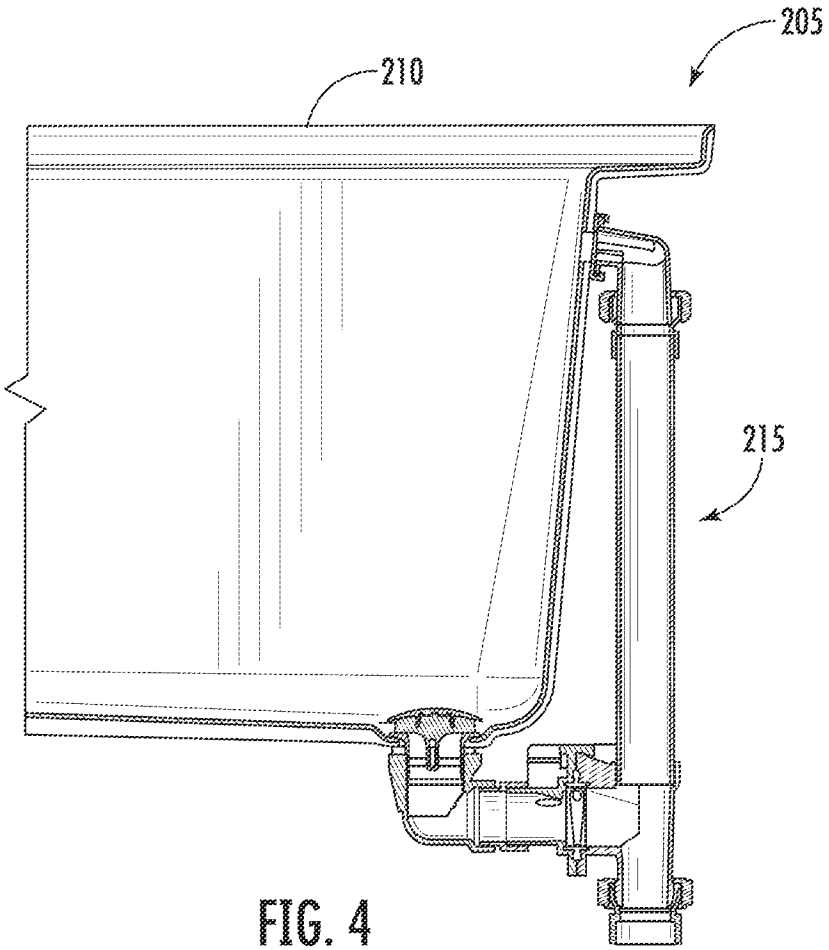
FIG. 4 is a side cross-sectional view of the drain system of FIG. 1, according to an exemplary embodiment.
Figure 3:
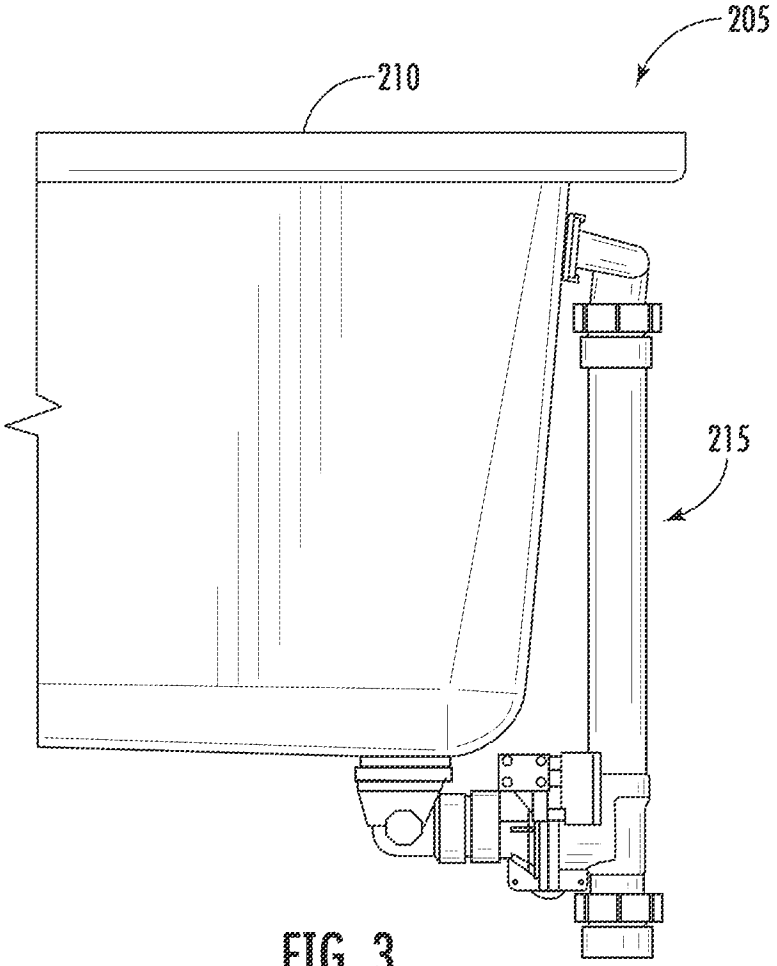
FIG. 3 is a reproduction of FIG. 2, near an attachment site of the drain system, according to an exemplary embodiment.
Figure 5:
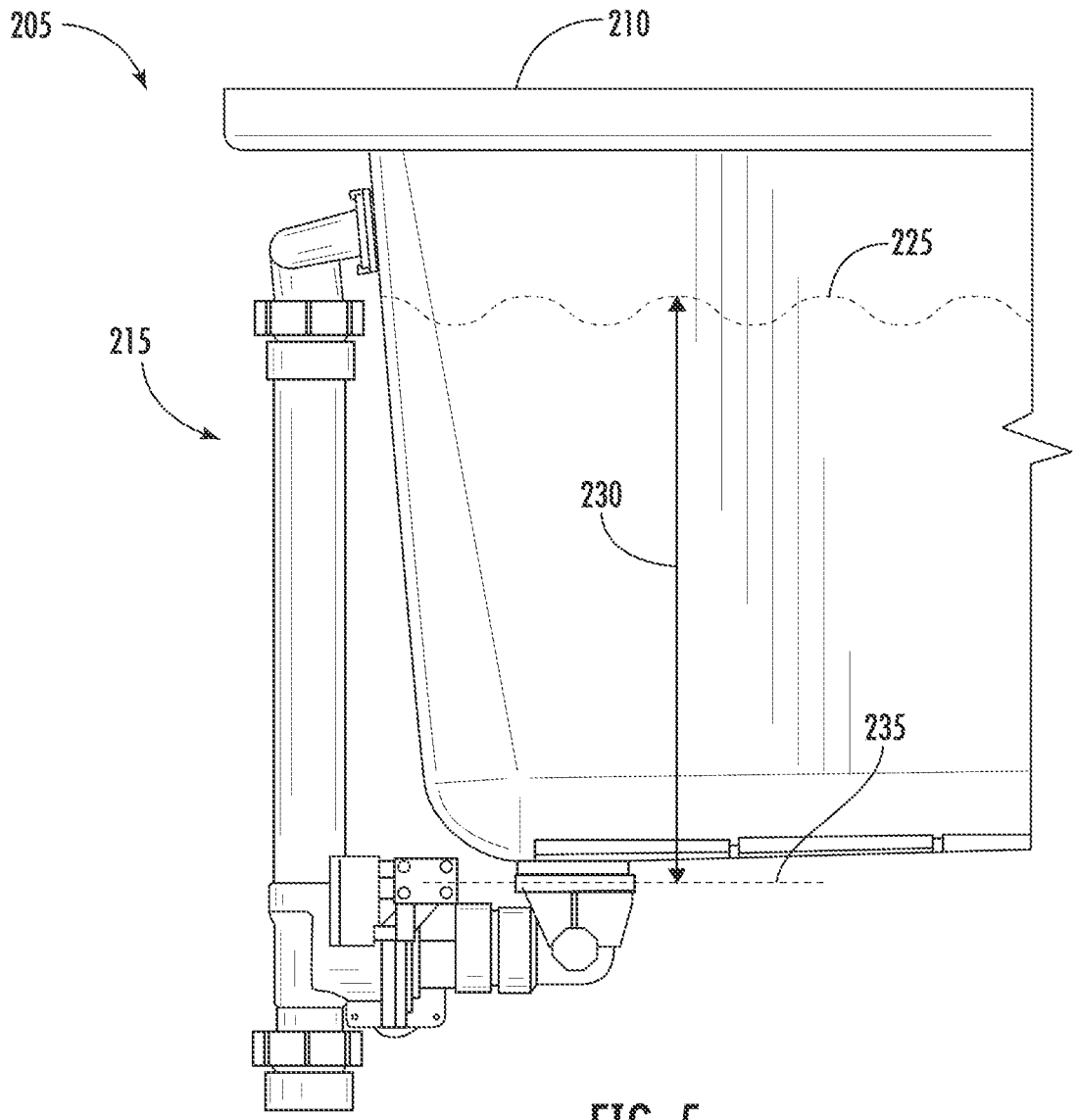
FIG. 5 is a side view of the drain system of FIG. 1 and representation of a bathtub fill height, according to an exemplary embodiment.

FIG. 2 shows a side view of a drain system 215 adapted to fit a bathtub, according to an exemplary embodiment. The drain system 215 may be configured to operate according to method 100. In FIG. 2, the drain system 215 is mounted to bathtub 210 to facilitate water flow through a main water exit drain and an overflow drain. FIGS. 3 and 4 show side and side cross-sectional views of the system 215 adapted to fit a bathtub 210, illustrating in greater detail the structure and connectivity of the system components. In FIG. 5, system 215 is shown from an opposite side view (as compared to FIGS. 3 and 4), illustrating a bathtub filled with water 225 and a corresponding water level determination 230 determined by a pressure sensor located within system 215 components beneath the bathtub 210 at a height 235 relative to the water 225.

Figure 7:
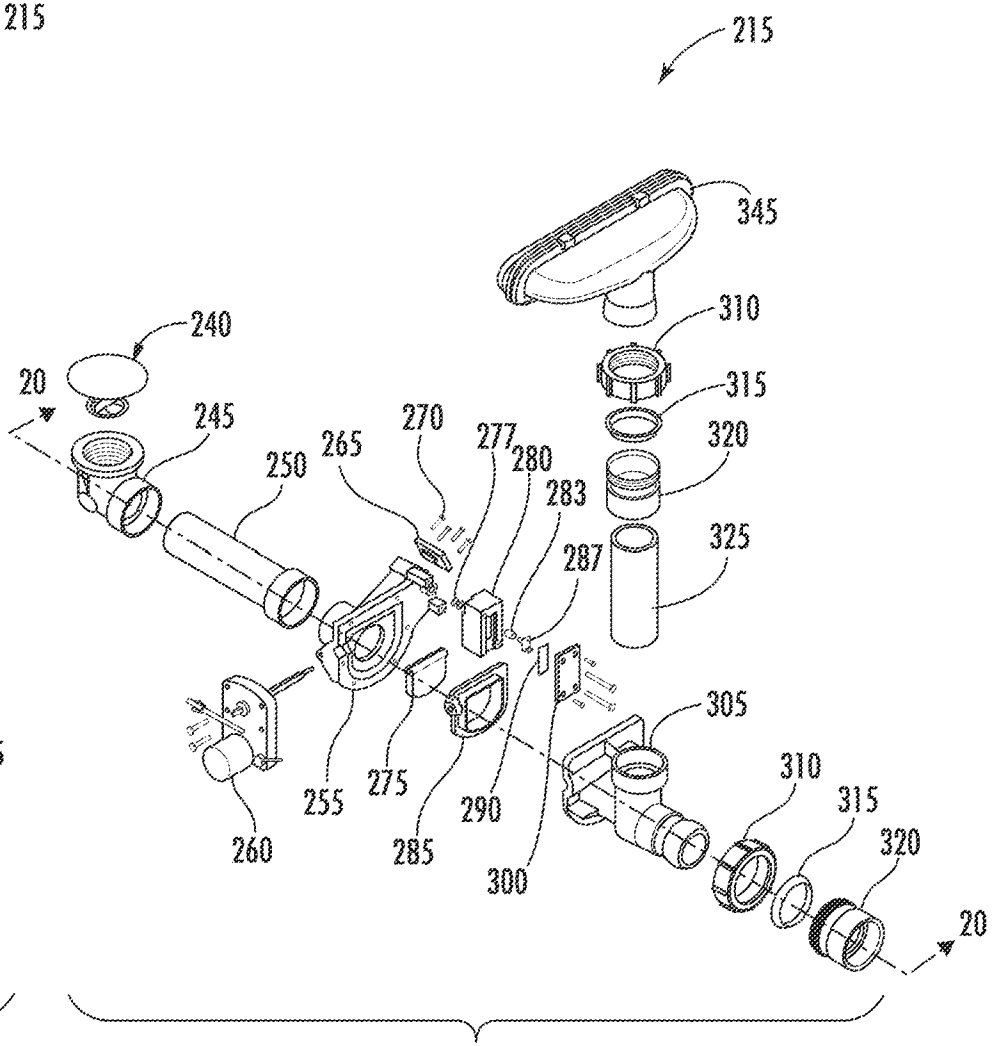
FIG. 7 is an exploded view of the drain system of FIG. 1 implementing a paddle valve design, according to another exemplary embodiment.
Figure 6:
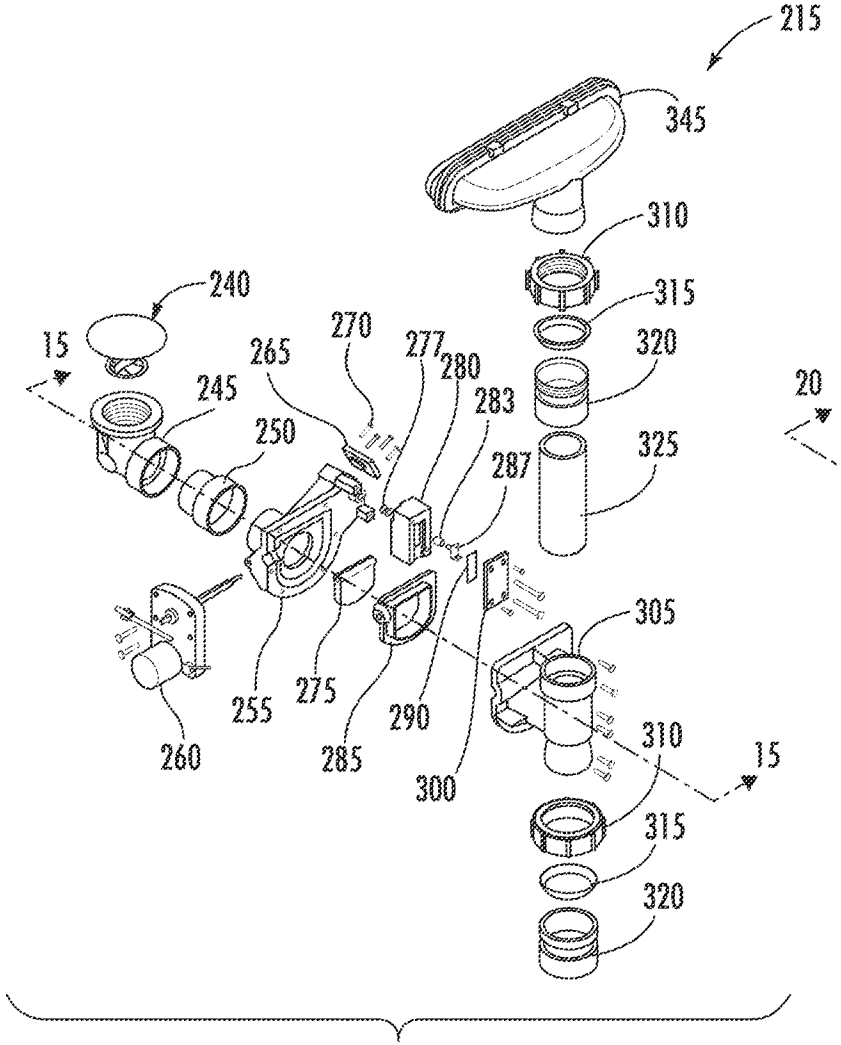
FIG. 6 is an exploded view of the drain system of FIG. 1 implementing a paddle valve design, according to an exemplary embodiment.

FIGS. 6 and 7 show exploded views of a drain system 215, according to exemplary embodiments. System 215 receives water flowing out of a coupled bathtub (such as bathtub 210) at drain exit assembly 240. Drainage subsequently flows through elbow drain 245 and through reducing coupler 250. Coupler 250 is fluidly connected to inlet and outlet valve bodies 255 and 305, respectively. Inlet and outlet valve bodies 255 and 305 house a gate ("paddle") valve 275 and valve seal 285. Valve 275 can be controlled to permit or prevent further water flow out of reducing coupler 250 depending on its position relative to seal 285 within valve bodies 255 and 305. The paddle valve 275 is controlled by motor 260, such that the motor 260 controls or changes an operational state of the valve 275 (e.g., changes the valve 275 position). Motor 260 can be electrically operated or manually overridden. Operation of motor 260 may be dependent on user-device input (e.g., via wired or wireless communication such as Bluetooth, WiFi, NFC, etc.) and/or sensed pressure information from a pressure sensor located in mounting block or housing 280. Pressure sensor mounting block or housing 280 is further coupled to valve bodies 255 and 305, in addition to pressure sensor circuit board 300, seals 283, sensor seals 283 and 287, and O-rings 277. The pressure sensor housing is coupled to the valve bodies 255 and 305 such that is located near an air passageway within inlet valve body 255. The air passageway within inlet valve body 255 is covered by air passageway cover 265 and fasteners 270 such that it contains an air bubble that is pressurized (and measurable by a pressure sensor) depending on the water level within bathtub 210. In various embodiments, the air bubble pressure may indicate occupancy of the bathtub 210.

In various exemplary embodiments, the system 215 may be configured to provide various safety or comfort features to a user of the bathtub 210. In various embodiments, the motor 260 may operate the valve 275 such that is in an open or closed position for a preset period of time. The system 215 may also be configured to adjust the valve 275 opening such that water exiting the bathtub 210 is not turbulent and produces minimal sound.

The outlet valve body 305 is fluidly coupled to receive water flow from pipe 325, which directs water exiting bathtub 210 via an overflow drain elbow assembly 345 and a first set of connecting swivel ball fittings (including swivel joint socket 320, joint gasket 315, and swivel joint fitting 310). Water exiting the bathtub via overflow elbow drain assembly 345 and paddle valve 275 assembly flow out through outlet valve body 305 and subsequently through a second set of connecting swivel ball fittings. Water flowing out of system 215 can then be connected to any additional downstream plumbing required to conclude water drainage.

In various exemplary embodiments, the system 215 may include a flow meter device fluidly coupled between the exit drain of the bathtub 210 and the valve 275 (e.g., to at least one of elbow drain 245, coupler 250, or inlet valve body 255). In various embodiments, the system 215 may monitor an amount and/or speed of water entering the system 215 from the exit drain and, consequently, facilitate the determination and setting of desired water flow characteristics (e.g. drainage rates). The system 215 may also be configured to provide digital information (e.g., via NFC, Bluetooth, WiFi, direct connection), such as to a user device, for the purposes of data analytics (e.g. temperature preferences, decay, trends, etc.). Digital information may be sourced from the thermistor 605, a pressure sensor in housing 280, the flow meter device, or any other measuring implement mechanically or communicably coupled to the system 215.

In various exemplary embodiments, the system 215 may be configured to operate based on one or more preset routines in response to input from a user device (e.g., received by the motor 260). Preset routines may be set by the user device and may include routines to sequentially or cyclically fill and/or drain water from the bathtub 210. Preset routines may operate based on a user device-determined point in time or according to a preset schedule defined by the user device. In various exemplary embodiments, such routines may include one or more purge cycle routines, whereby the system 215 facilitates scheduled cleaning of the coupled bathtub 210.

The system 215 can be configured to accommodate various installation requirements, including facilitating drainage from a bathtub 210 above or below flooring on which bathtub 210 is located, or in front of or behind surrounding structures near which bathtub 210 is located. Adaptations of system 215 can be accomplished through adjusting swivel ball fittings (including swivel joint socket 320, joint gasket 315, and swivel joint fitting 310) and/or using various configurations of outlet valve body 305. FIG. 6 shows a vertical configuration for outlet valve body 305 and FIG. 7 shows a 90 degree ("horizontal") configuration for outlet valve body 305.

Figure 10:
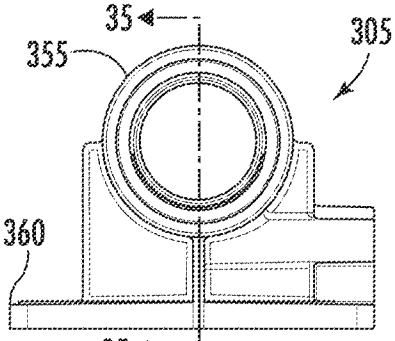
FIG. 10 is a top view of the outlet valve body of FIG. 8, according to an exemplary embodiment.
Figure 9:
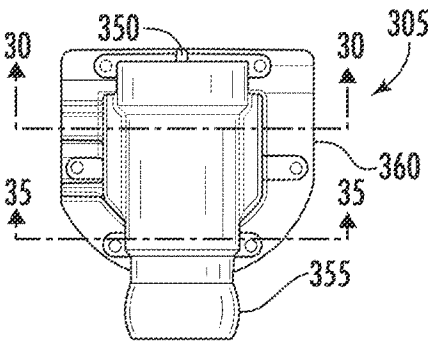
FIG. 9 is a front view of the outlet valve body of FIG. 8, according to an exemplary embodiment.

FIGS. 8-16 show an outlet valve body 305 in a vertical configuration, in accordance with an exemplary embodiment. Locations 350 and 355 on outlet valve body 305 indicate locations of water inlet and outlet, respectively. Outlet valve body 305 is coupled to system 215, such as to inlet valve body 255 via base plate 360. FIG. 9 illustrates a front view of outlet valve body 305 wherein water enters at location 350 downward to location 355. FIG. 10 shows a bottom, end view near location 355, illustrating a substantially straight water flow path through outlet valve body 305.

Figure 13:
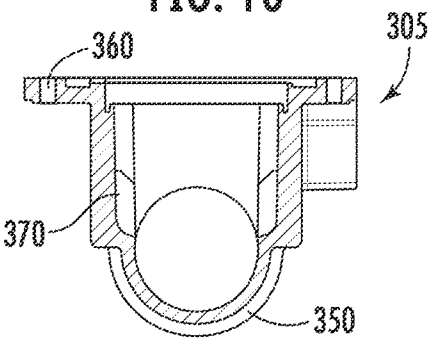
FIG. 13 is a cross-sectional view of the outlet valve body of FIG. 8 taken along line 25-25 of FIG. 9, according to an exemplary embodiment.
Figure 16:
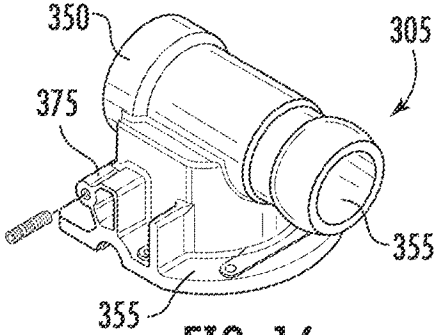
FIG. 16 is a perspective view of the outlet valve body of FIG. 8, according to an exemplary embodiment.
Figure 12:
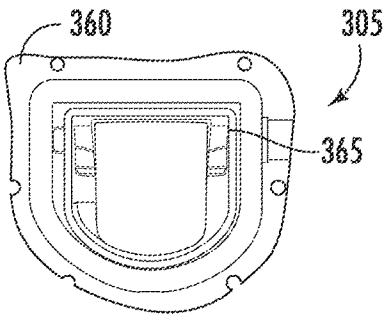
FIG. 12 is a reproduction of FIG. 11 near a valve paddle interface, according to an exemplary embodiment.
Figure 15:
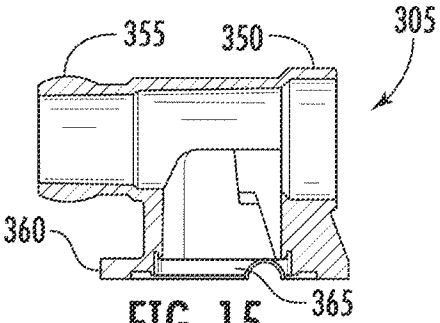
FIG. 15 is a cross-sectional view of the outlet valve body of FIG. 8 taken along line 35-of FIG. 10, according to an exemplary embodiment.
Figure 8:
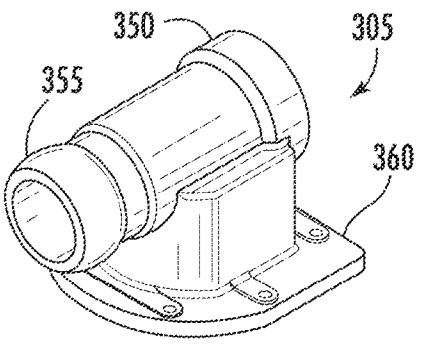
FIG. 8 is a perspective view of an outlet valve body of the drain system of FIG. 6, according to an exemplary embodiment.
Figure 11:
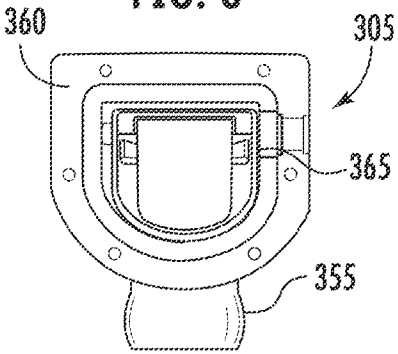
FIG. 11 is an end view of the outlet valve body of FIG. 8, according to an exemplary embodiment.
Figure 14:
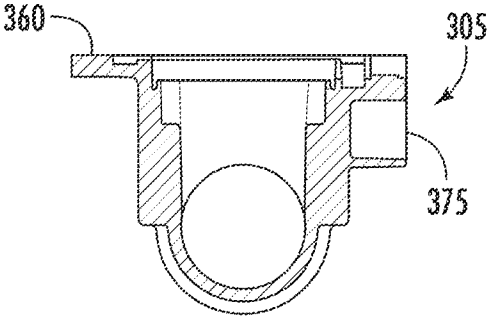
FIG. 14 is a cross-sectional view of the outlet valve body of FIG. 8 taken along line 30-of FIG. 9, according to an exemplary embodiment.
Figure 19:
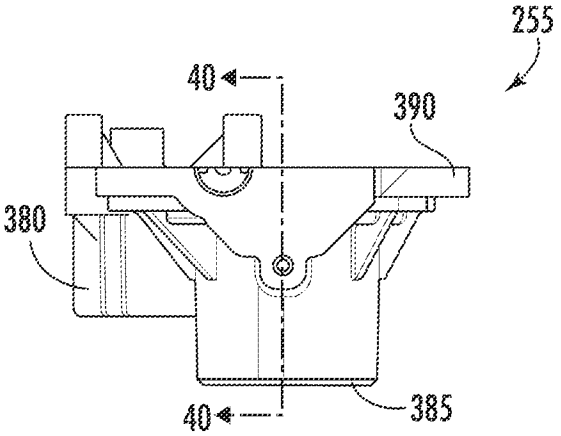
FIG. 19 is a side view of the inlet valve body of FIGS. 17-18, according to exemplary embodiments.

FIGS. 11-12 show end views of outlet valve body 305, illustrating features 365 to facilitate coupling of a paddle valve 275 and seal 285. FIGS. 13-14 show cross-sectional views of outlet valve body 305 taken along lines 25-25 and 30-30 of FIG. 9, respectively, which illustrate features to facilitate smooth water flow (feature 370) and enable connectivity to inlet valve body 255 and motor 260 (feature 375). FIG. 15 shows a side cross-sectional view of outlet valve body 305 taken along line 35-35 of FIG. 10, illustrating additional feature 365, which encourages smooth water flow through outlet valve body 305. FIG. 16 shows a perspective view of outlet valve body 305 opposite the view shown in FIG. 8, illustrating feature 375 which enables connectivity to inlet body valve body 255 and motor 260.

Figure 22:
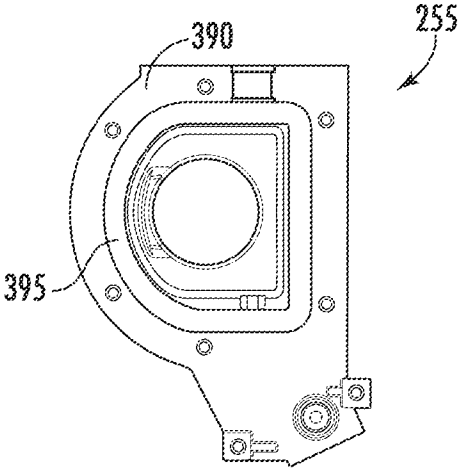
FIG. 22 is a front end view of the inlet valve body of FIGS. 17-18, according to an exemplary embodiment.
Figure 18:
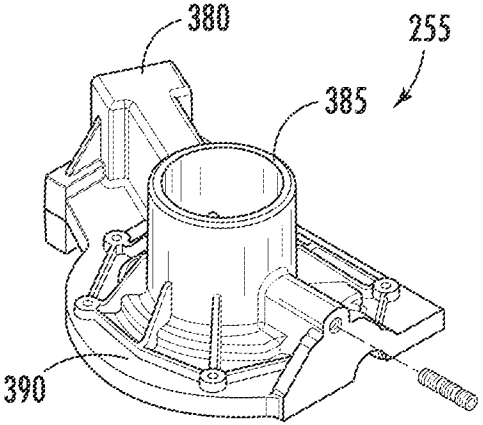
FIGS. 17-18 are perspective views of the inlet valve body of the drain system of FIGS. 6-7, according to exemplary embodiments.
Figure 21:
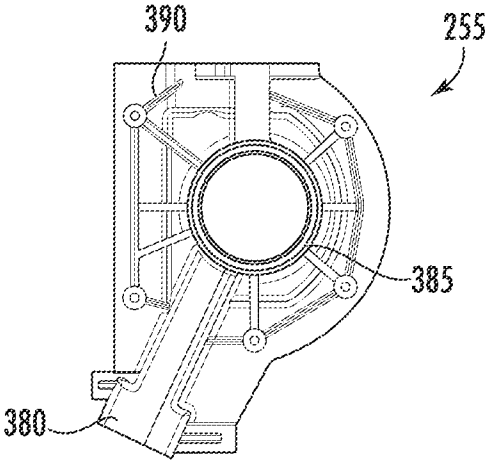
FIG. 21 is a back end view of the inlet valve body of FIGS. 17-18, according to an exemplary embodiment.
Figure 17:
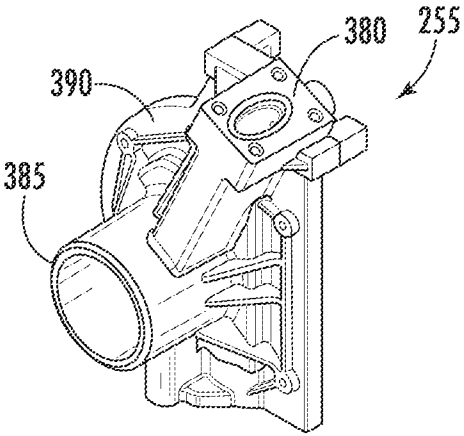
Figure 20:
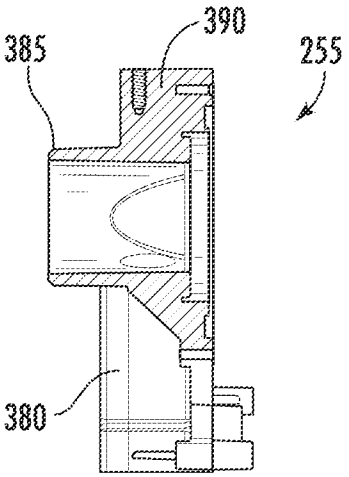
FIG. 20 is a cross-sectional view of the inlet valve body of FIGS. 17-18 taken along line of FIG. 19, according to exemplary embodiments.

FIGS. 17-22 show an inlet valve body 255, according to an exemplary embodiment. FIGS. 17-18 and FIGS. 19-20 show perspective and cross-sectional views, respectively, of an inlet valve body 255, which includes base plate 390 for connectivity to outlet body valve 305, air passage features 380 to facilitate pressure sensing, and inlet feature 385 through which water enters the inlet valve body 255. FIGS. 21-22 show alternate cross-sectional views, respectively, of inlet valve body 255 to additionally illustrate feature 395, which facilitates coupling of paddle valve 275 and seal 285 to inlet valve body 255.

Figure 25:
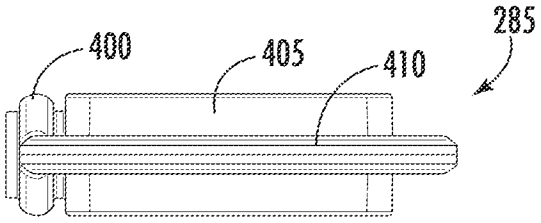
FIG. 25 is a top view of the valve seal of FIG. 23, according to an exemplary embodiment.
Figure 28:
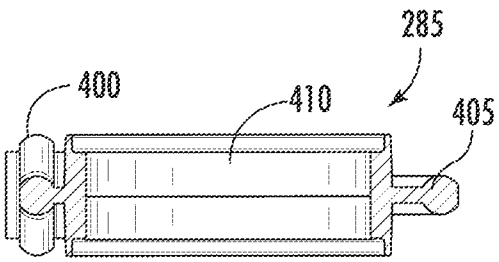
FIG. 28 is a top cross-sectional view of the valve seal of FIG. 23 taken along line 50-50 of FIG. 23, at a position below a connection to the valve body, according to an exemplary embodiment.
Figure 29:
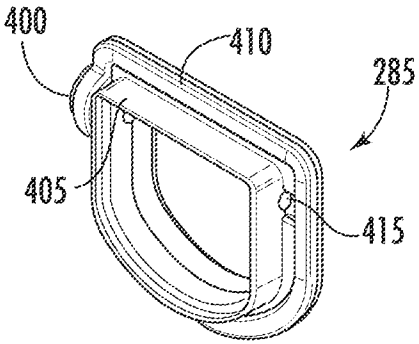
FIG. 29 is a perspective view of the valve seal of FIG. 23, according to an exemplary embodiment.
Figure 24:
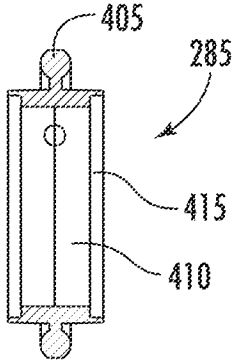
FIG. 24 is a side cross-sectional view of the valve seal of FIG. 23 taken along line 42-42 of FIG. 23, according to an exemplary embodiment.
Figure 27:
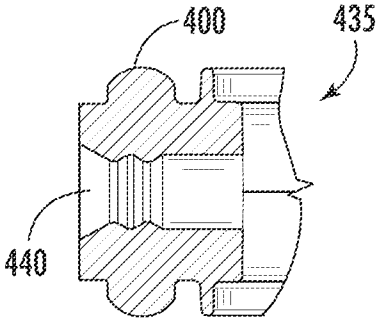
FIG. 27 is a reproduction of FIG. 26 near a valve seal connection to a valve body, according to an exemplary embodiment.
Figure 23:
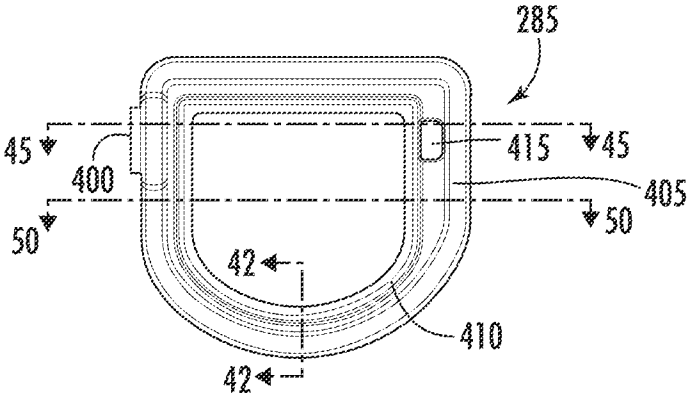
FIG. 23 is a front view of the valve seal of the drain system of FIGS. 6-7, according to an exemplary embodiment.
Figure 26:
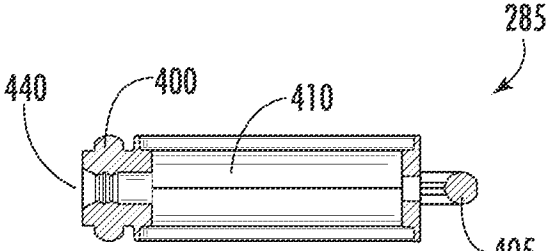
FIG. 26 is top cross-sectional view of the valve seal of FIG. 23 taken along line 45-45 of FIG. 23, according to an exemplary embodiment.

FIGS. 23-29 show a paddle valve seal 285, according to an exemplary embodiment. FIG. 23 shows a front view of valve seal 285, illustrating connectivity features 400 and 415 which facilitate connectivity to inlet and outlet valve bodies 255 and 305 (such as to features 375 and/or 390). FIG. 23 also shows outer sealing features 405 and inner sealing features 410 which facilitate the generation of an effective seal between a paddle valve 275 and inlet and outlet valve bodies 255 and 305. FIG. 24-25 show side cross-sectional (along line 42-42) and outer top views of valve seal 285, further illustrating features 400, 405, and 410. FIGS. 26-27 show a top cross-sectional view (along line 45-45) of seal 285, illustrating connectivity feature 440 within feature 400 to enable coupling to and operation of paddle valve 275 relative to seal 285. FIG. 28 shows a top cross-sectional view of seal 285 along line 50-50. FIG. 29 shows a perspective view of seal 285, illustrating sealing features 405 and 410 ad connectivity features 400 and 415.

Figure 32:
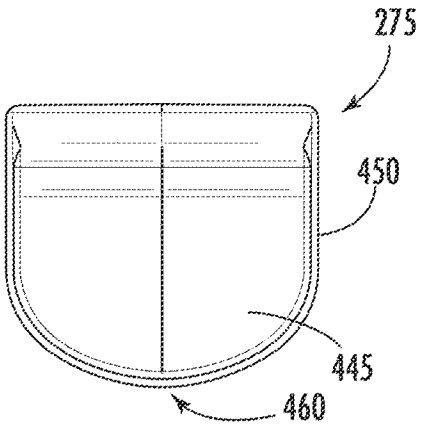
FIG. 32 is a side view of the paddle valve of FIG. 30, according to an exemplary embodiment.
Figure 34:
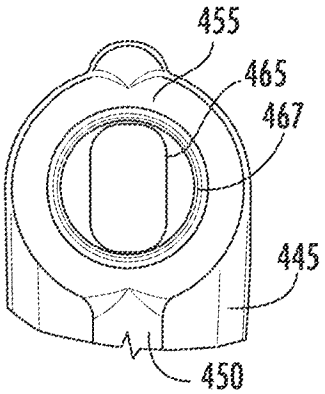
FIGS. 33-34 are reproductions of FIG. 32 near a connection point of the paddle valve to the valve seal, according to exemplary embodiments.
Figure 36:
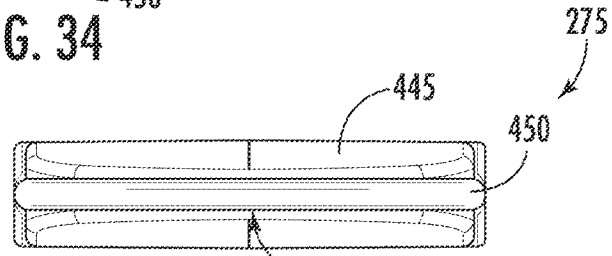
FIG. 36 is a bottom view of the paddle valve of FIG. 30, according to an exemplary embodiment.
Figure 31:
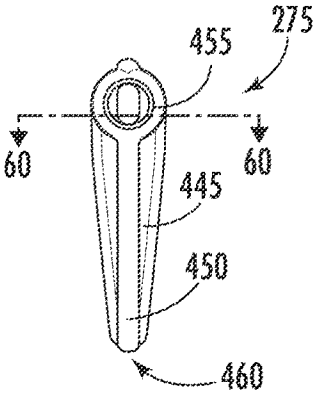
FIG. 31 is a front view of the paddle valve of FIG. 30, according to an exemplary embodiment.
Figure 30:
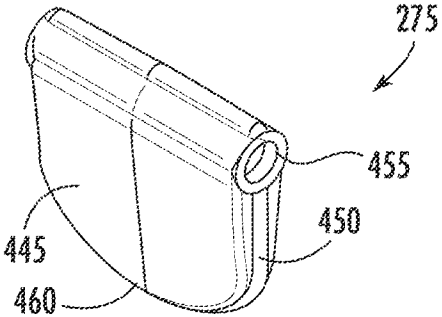
FIG. 30 is a perspective view of the paddle valve of the drain system of FIGS. 6-7, according to an exemplary embodiment.
Figure 33:
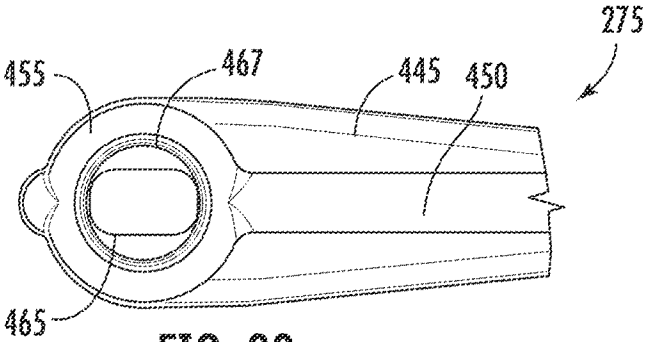
Figure 35:
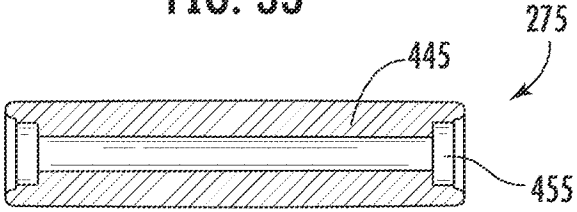
FIG. 35 is a top cross-sectional view of the paddle valve of FIG. 30 taken along line 60-60 of FIG. 31, through a connection point of the paddle valve to the valve seal, according to an exemplary embodiment.

FIGS. 30-36 show a paddle valve 275, according to an exemplary embodiment. FIG. 30 shows a perspective view of paddle valve 275 including a main valve surface 445 which provides a barrier for water flow from a bathtub exit drain through system 215. When the paddle valve is closed, outer edge 450 on valve 275 engages with seal 285 to form a watertight seal, thereby preventing water flow. When the paddle valve 275 is opened, end 460 is rotated away from the direction of water flow about connectivity point 455 to permit water flow through system 215 from a bathtub exit drain. FIGS. 31-32 show side and front views, respectively, of paddle valve 275 to further illustrate features 450, 455, 445, and 460. FIGS. 33-34 show side views of paddle valve 275 to illustrate additional features 465 and 467, which enable the paddle valve 275 to be coupled to seal 285, inlet and outlet valve bodies 255 and 305, and motor 260. As illustrated in FIG. 35, which shows a cross-sectional view of paddle valve 275 taken along line 60-60 of FIG. 31, the connectivity point 455 may be configured to extend along a length of the paddle valve 275. As shown in FIG. 36, which is an end view of the paddle valve 275, the main valve surface 445 may have a greater thickness as compared to that of the outer edge 450.

Figure 39:
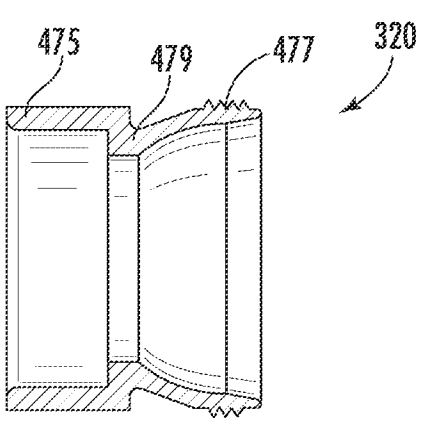
FIG. 39 is a side cross-sectional view of the swivel joint socket of FIG. 37 taken along line 65-65 of FIG. 38, according to an exemplary embodiment.
Figure 38:
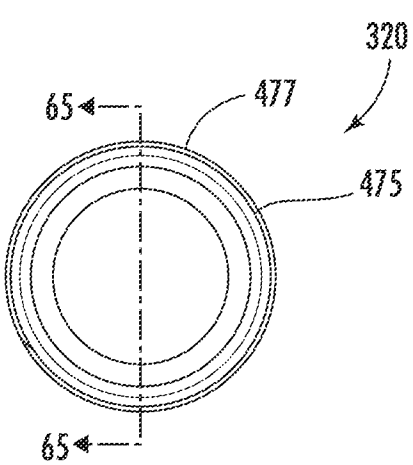
FIG. 38 is an end view of the swivel joint socket of FIG. 37, according to an exemplary embodiment.
Figure 37:
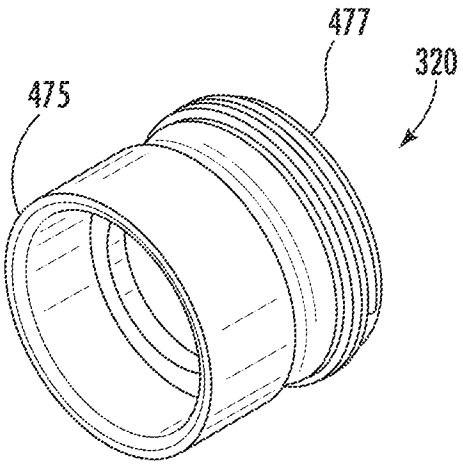
FIG. 37 is a perspective view of a swivel joint socket of the drain system of FIG. 6, according to an exemplary embodiment.

FIGS. 37-39 show a swivel joint socket 320, according to an exemplary embodiment. Swivel joint socket 320 may be used within system 215 to facilitate modular connectivity therein. FIG. 37 shows a perspective view of swivel joint socket 320, illustrating a water flow inlet location 477 and a water flow outlet location 475. FIG. 38 shows an end view of swivel joint 320, further illustrating relative positions of features 475 and 477. FIG. 39 shows a side cross sectional view of swivel joint socket 320 taken along line 65-65 of FIG. 38, illustrating feature 479 positioned between locations 475 and 477 to facilitate smooth water flow.

Figure 42:
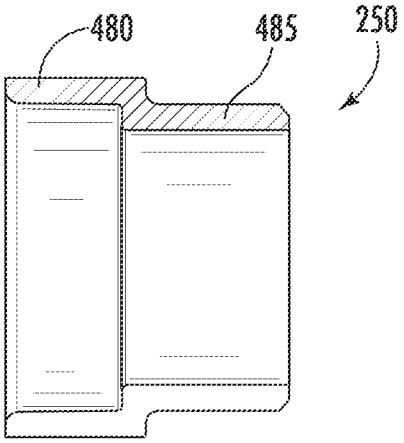
FIG. 42 is a cross-sectional view of the reducing coupler of FIG. 40 taken along line 70-70 of FIG. 41, according to an exemplary embodiment.
Figure 41:
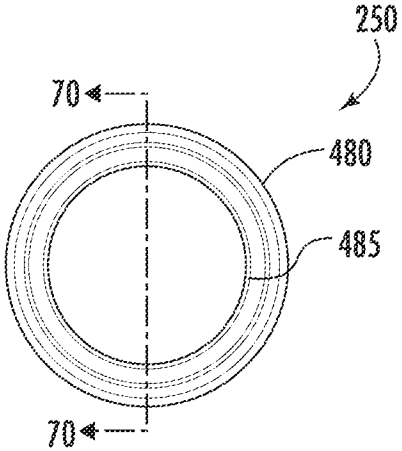
FIG. 41 is an end view of the reducing coupler of FIG. 40, according to an exemplary embodiment.
Figure 40:
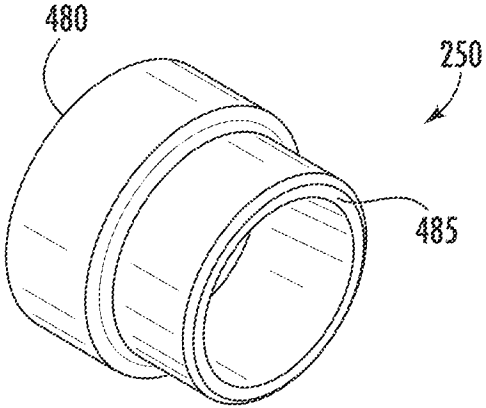
FIG. 40 is a perspective view of a reducing coupler of the drain system of FIGS. 6-7, according to an exemplary embodiment.

FIGS. 40-42 show a reducing coupler 250, according to an exemplary embodiment. FIG. shows a perspective view of reducing coupler 250, illustrating water inlet location 480 and water outlet location 485. FIGS. 41-42 show end and side cross-sectional views (taken along line of FIG. 41), respectively, of reducing coupler 250 to illustrate the relative dimensions of reducing coupler 250 at locations 480 and 485.

Figure 44:
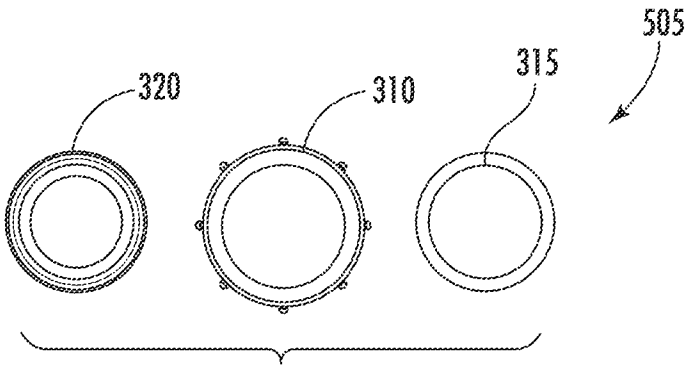
FIG. 44 shows end views of each component of the swivel ball fittings kit of FIG. 43, according to an exemplary embodiment.
Figure 43:
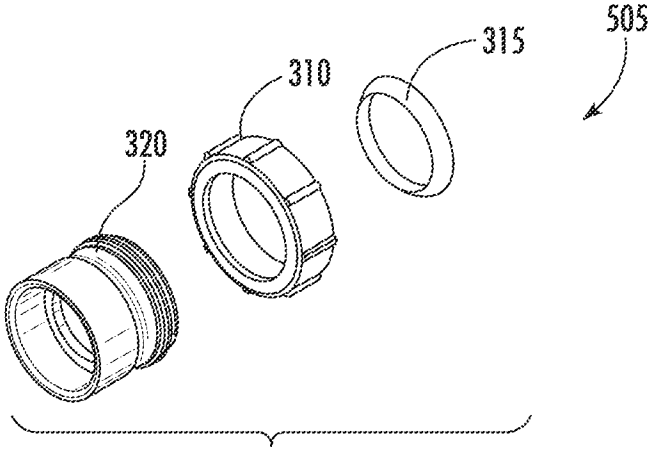
FIG. 43 is a perspective view of a swivel ball fittings kit of the drain system of FIGS. 6-7, according to an exemplary embodiment.

FIGS. 43-44 show exploded perspective and end views, respectively of a swivel ball fittings kit 505, according to an exemplary embodiment. Swivel ball fittings kit 505 includes swivel joint socket 320, swivel joint fitting 310, and joint gasket 315. Swivel ball fittings kit 505 may be implemented within system 215 to enable adaptation and/or customization of system 215 to a multitude of installation locations.

Figure 47:
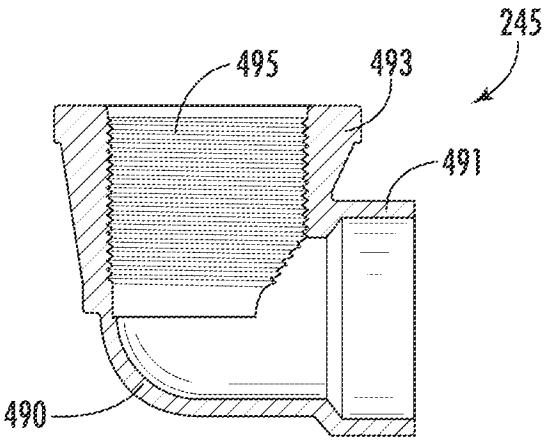
FIG. 47 is a side cross-sectional view of the drain elbow of FIG. 45 taken along line 75-75 of FIG. 46, according to an exemplary embodiment.
Figure 46:
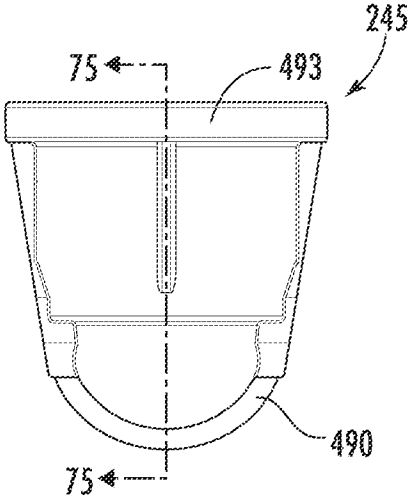
FIG. 46 is an end view of the drain elbow of FIG. 45, according to an exemplary embodiment.
Figure 45:
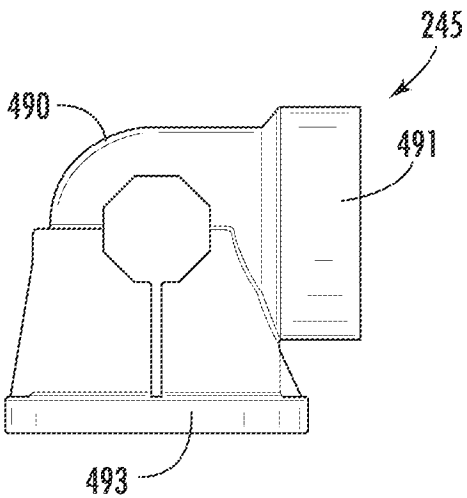
FIG. 45 is a side view of a drain elbow of the drain system of FIGS. 6-7, according to an exemplary embodiment.

FIGS. 45-47 show an elbow drain 245, according to an exemplary embodiment. FIGS. show side and end views, respectively of elbow drain 245 to illustrate water inlet location 493, 90 degree bend 490, and water outlet location 491. FIG. 47 shows a side cross-sectional view of elbow drain 245 (taken along line 75-75 of FIG. 46), further illustrating inner features 495 to facilitate the coupling of a drain cover assembly 240.

Figure 48:
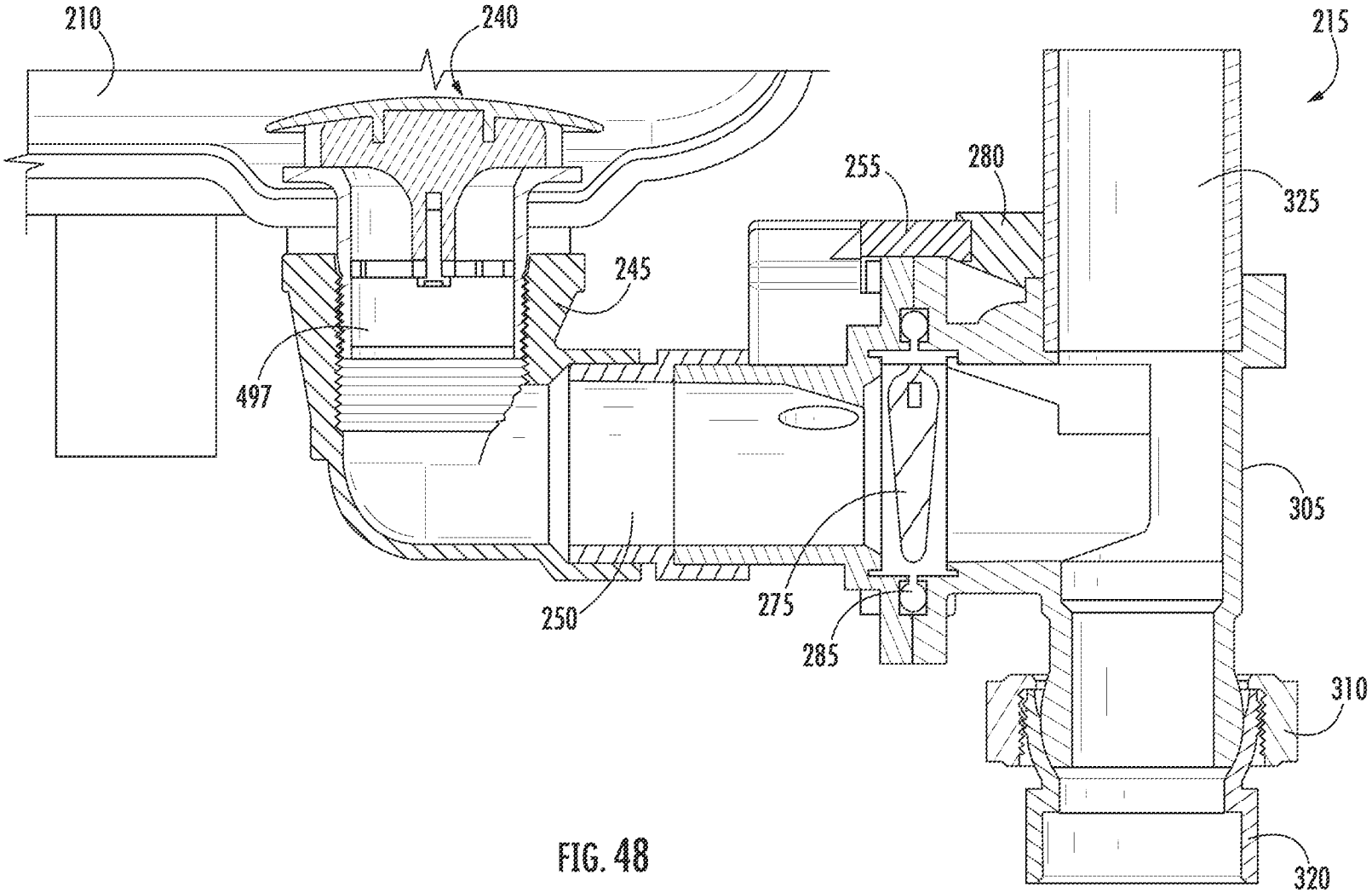
FIG. 48 is a side cross-sectional view of the paddle valve design for a drain system near a bathtub exit drain with a vertically oriented swivel joint taken along line 15-15 of FIG. 6, according to an exemplary embodiment.
Figure 49:
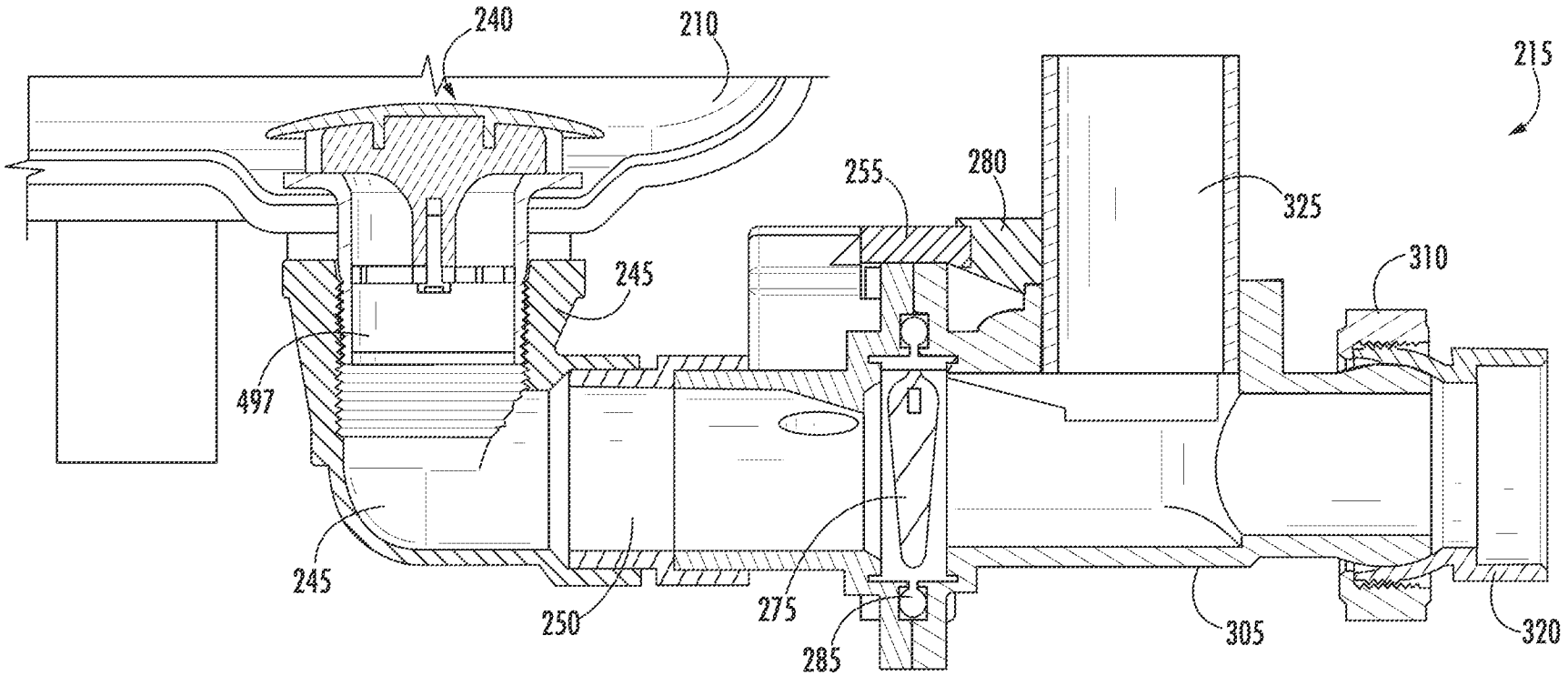
FIG. 49 is a side cross-sectional view of a paddle valve design for a drain system near a bathtub exit drain with a horizontally oriented swivel joint taken along line 20-20 of FIG. 7, according to an exemplary embodiment.
Figure 50:
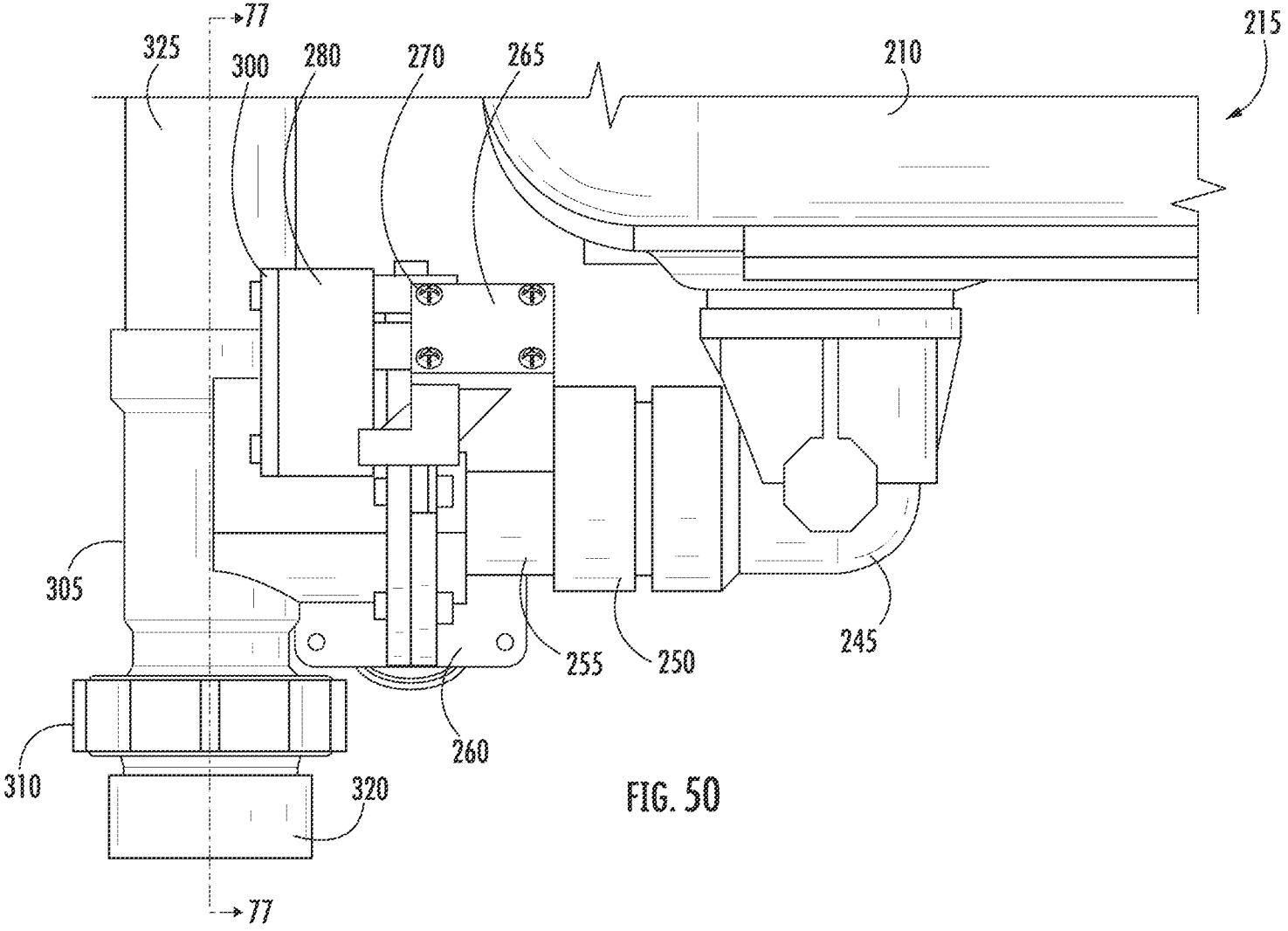
FIG. 50 is a side view of a paddle valve design for a drain system near a pressure sensor, according to an exemplary embodiment.
Figure 51:
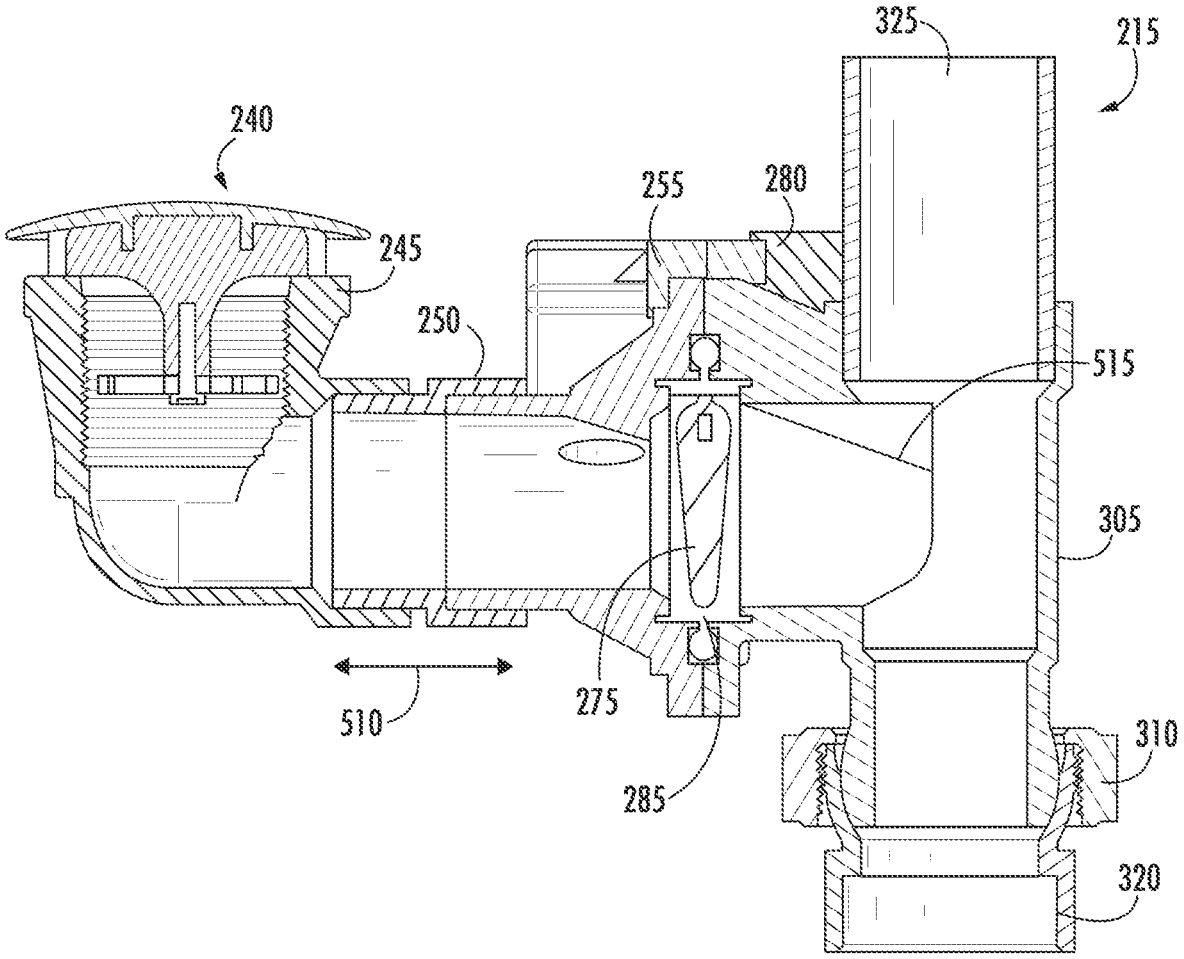
FIG. 51 shows a side cross-sectional view of a drain system near a reducing coupler and a valve input taken along line 15-15 of FIG. 6, according to an exemplary embodiment.
Figure 52:
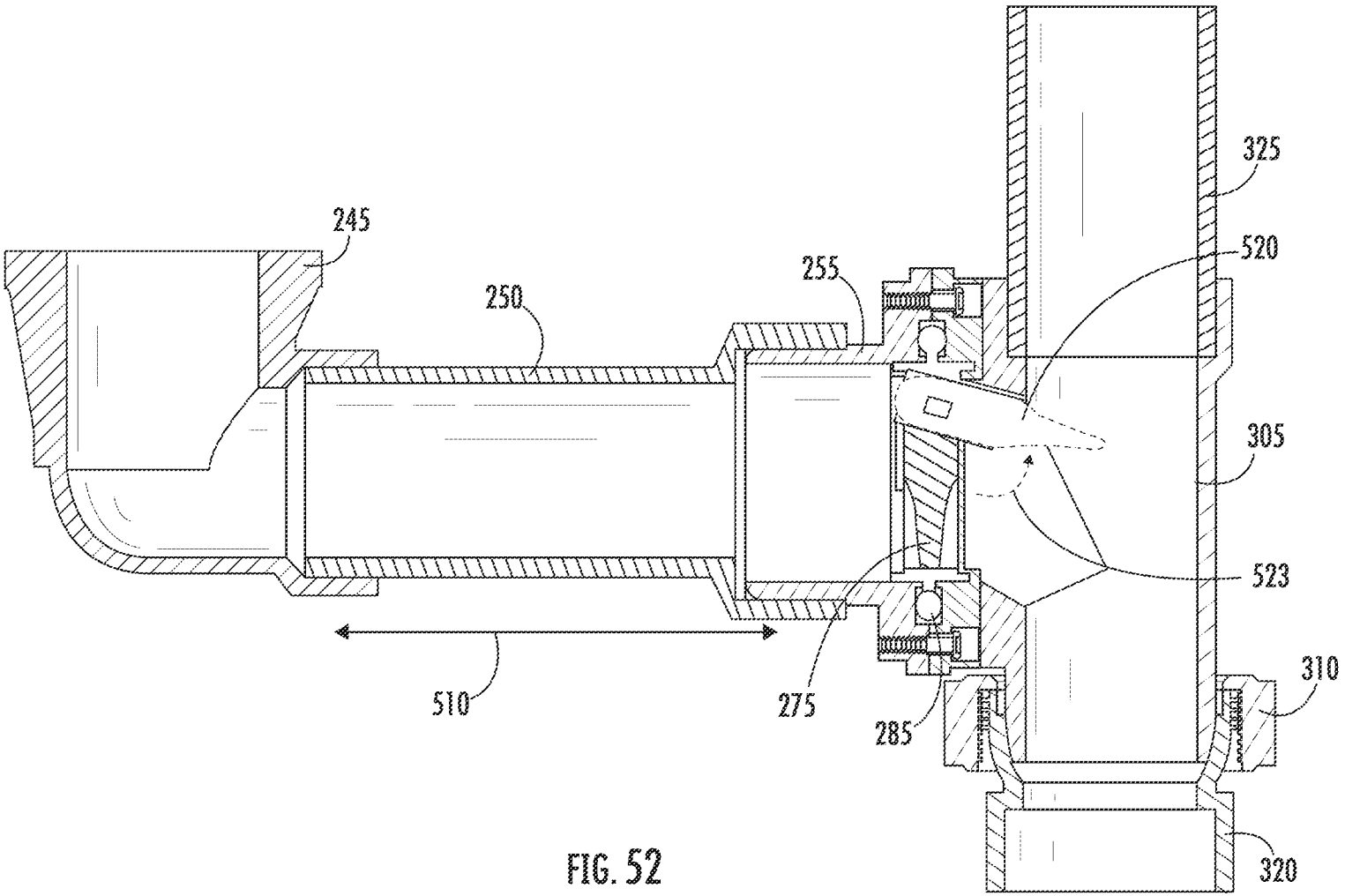
FIG. 52 shows a side cross-sectional view of a drain system near a reducing coupler and valve input taken along line 15-15 of FIG. 6, according to another exemplary embodiment.
Figure 53:
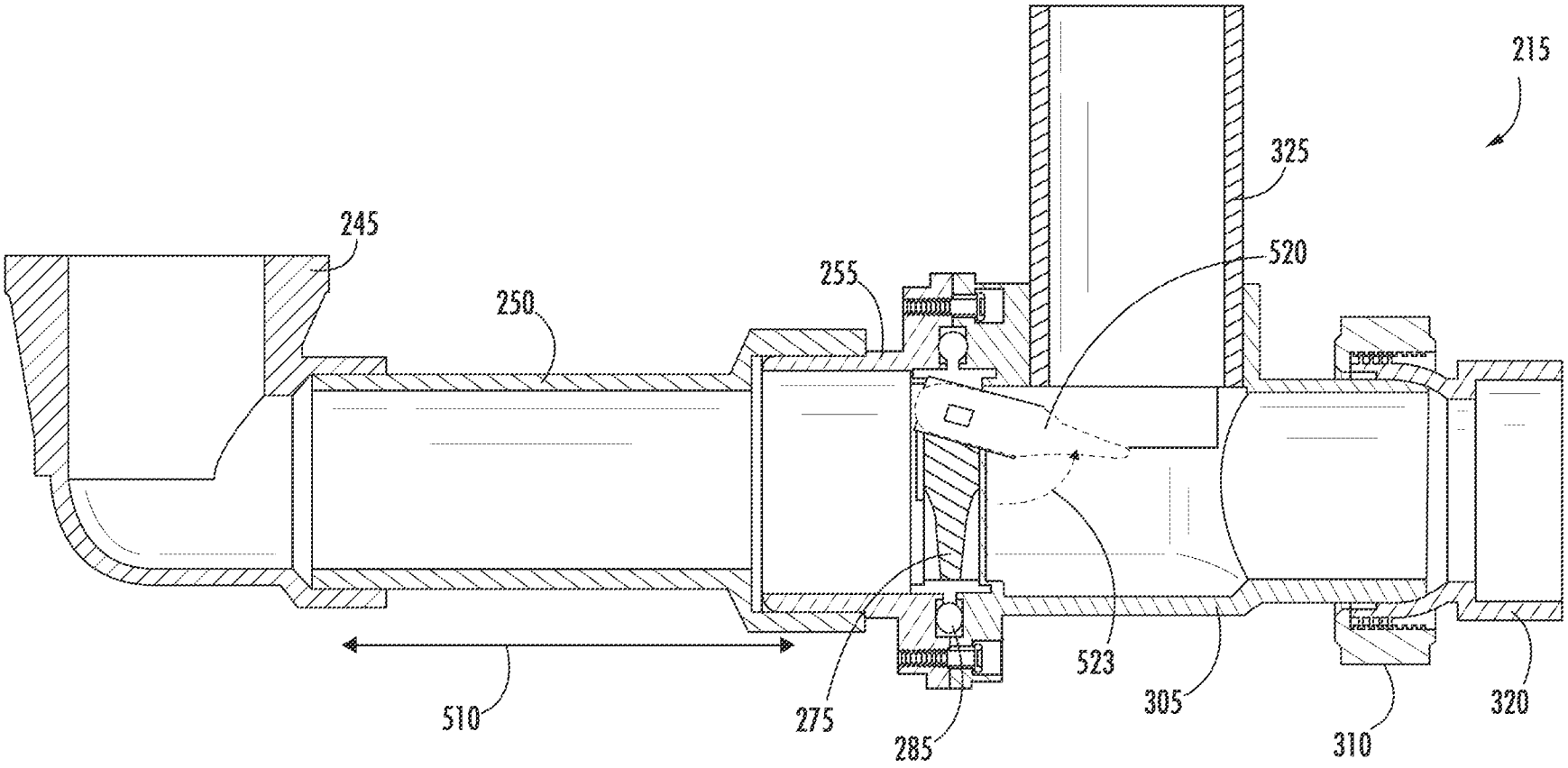
FIG. 53 shows a side cross-sectional view of a drain system near a reducing coupler and valve input taken along line 20-20 of FIG. 7, according to another exemplary embodiment.

FIGS. 48-53 show side views of system 215 near components that facilitate water flow out of a bathtub 210 exit drain, according to various exemplary embodiments. FIGS. 48-49 show a side cross-sectional view of system 215 (taken along line 15-15 of FIG. 6 and line 20-20 of FIG. 7, respectively) installed above flooring near the bathtub 210 exit drain and paddle valve 285, illustrating alternate configurations of outlet valve body 305. FIG. 48 shows a vertical or linear configuration for outlet valve body 305, enabling water to flow directly downward after passage through valve 275 and/or pipe 325. FIG. 49 shows a 90 degree or horizontal configuration for outlet valve body 305, enabling water to flow outward after passage through valve 275 and/or pipe 325. As shown the outlet valve body 305 may include one or more contoured features 515 to facilitate quiet water flow through the system 215. FIG. 50 shows a side view of system 215 installed below flooring near a bathtub 210 exit drain, illustrating an alternate configuration for system 215 installation. FIGS. 51-53 show side cross-sectional views of system 215 near the bathtub 210 exit drain, highlighting a distance 510 between elbow drain 245 and inlet valve body 255. In various embodiments, system 215 may have a different distance 510 to accommodate installation requirements (e.g., size or type of the bathtub 210, plumbing connecting to the bathtub 210, etc.). FIGS. 52-53 also illustrate an alternate position 520 for paddle valve 275, corresponding to an open valve configuration. Paddle valve 275 may be in position 520 after a rotation 523 caused by motor 260.

Notably, the position of the paddle valve 275 as shown in FIG. 52 is angled downward in the fully open position. Advantageously, this positioning of the paddle valve 275 directs water to flow downward into the adjacent drain pipe structure, which the inventors have found significantly increases the speed at which water may drain from the bathtub 210. According to one exemplary embodiment, water may drain from the tub 210 up to approximately 25% more quickly than if the pipes simply met at a 90 degree angle without the water being directed in manner that allows it to flow downward in the drain pipe. Without being limited to a particular theory, one potential reason for this increased drainage speed may be the reduction in cavitation in the water being drained as a result of controlling the fluid to flow in the desired direction.

Figure 54:
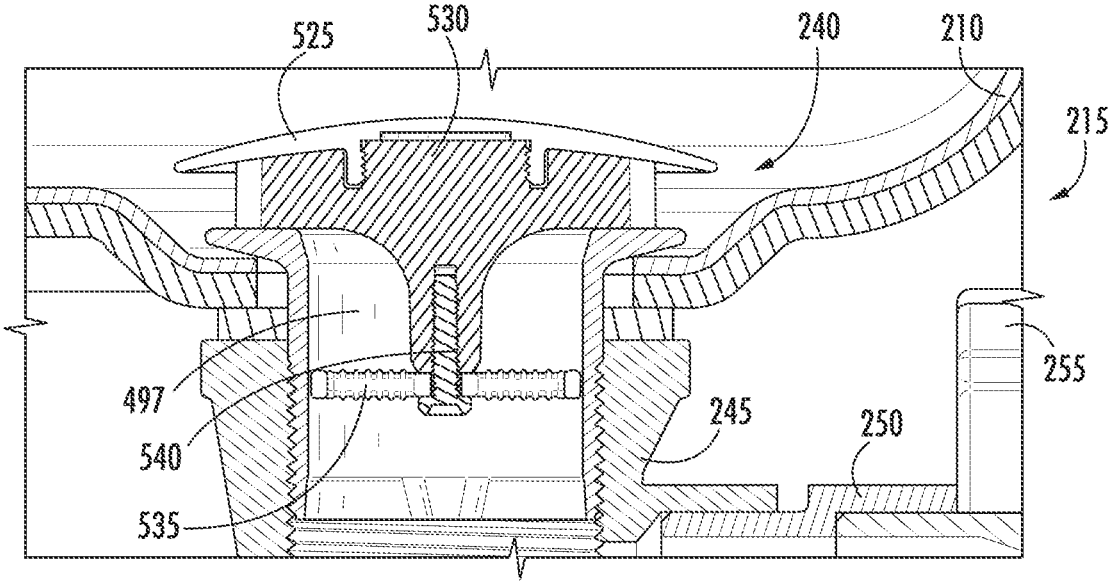
FIG. 54 shows a side cross-sectional view of a drain system near a bathtub exit drain taken along line 15-15 of FIG. 6, according to an exemplary embodiment.
Figure 55:
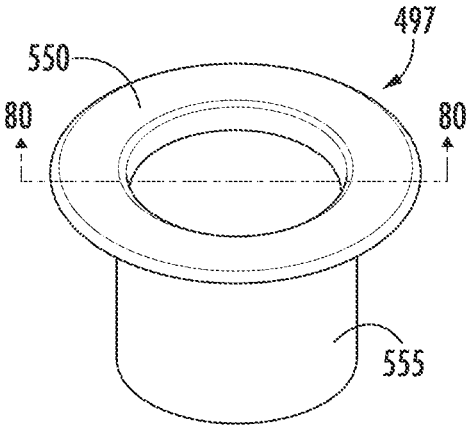
FIG. 55 shows a perspective view of a bath drain strainer body of the drain system of FIG. 54, according to an exemplary embodiment.
Figure 56:
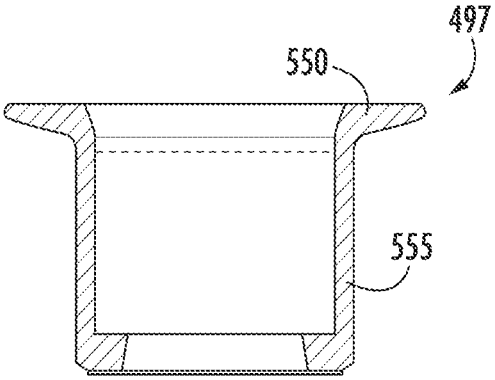
FIG. 56 shows a side cross-sectional view of the bath drain strainer body of FIG. 55 taken along line 80-80 of FIG. 55, according to an exemplary embodiment.
Figure 57:
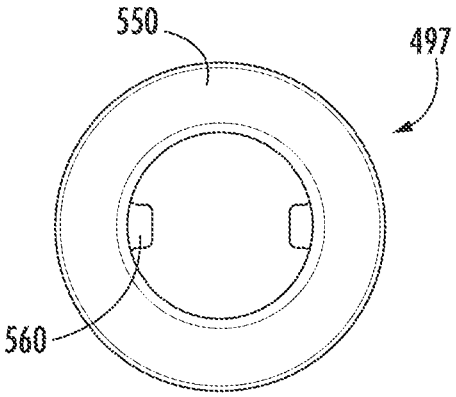
FIG. 57 shows a top view of the bath drain strainer body of FIG. 55, according to an exemplary embodiment.
Figure 58:
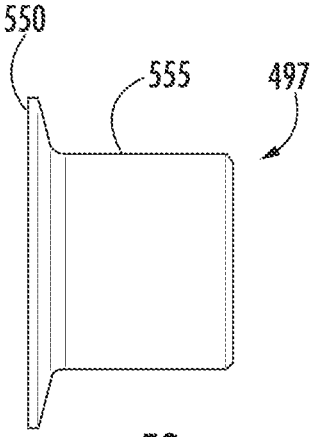
FIG. 58 shows a side view of the bath drain strainer body of FIG. 55, according to an exemplary embodiment.

FIG. 54 shows a side cross-sectional view of system 215 (taken along line 15-15 of FIG. 6) near the bathtub 210 exit drain, illustrating the configuration of drain cover assembly 240 and comprising parts, including drain stopper 525, drain post 530, strainer 535, and attaching screw 540. FIGS. 55-58 show a bath drain strainer body 497, according to exemplary embodiments. FIGS. 55-56 show perspective and side cross-sectional views, respectively, of drain strainer body 497, illustrating upper surface 550 (to interface with drain post 530) and round surface 555 (to interface with elbow drain 245). FIG. 57 shows a top view of drain strainer body 497 additionally illustrating features 560 to interface with drain cover assembly 240. FIG. 58 shows a side view of drain strainer body 497.

FIG. 59 shows an exploded view of drain cover assembly 240 (including drain stopper 525, drain post 530, drain strainer 535, and connecting screw 540), according to an exemplary embodiment. FIGS. 60-61 show top and side views of drain stopper 525 which prevents large debris from entering system 215. As illustrated in FIG. 62, which is a cross-sectional view of the drain stopper 525 taken along line 85-85 of FIG. 60, the drain stopper 525 may be dome shaped. FIGS. 63 and 64 show top and side views, respectively of drain post 530, illustrating central post 580 which interfaces with drain stopper 525, features 575 to catch unwanted debris from entering system 215, and post 570 to couple with drain strainer 535. FIGS. 65-66 show top and side views, respectively, of drain strainer 535, to illustrate central aperture 585 which facilitates coupling to drain post 530. In addition FIGS. 65-66 illustrate outer ring 595, radial arms 590, and texture features 600 to prevent any remaining debris from entering system 215.

Figure 68:
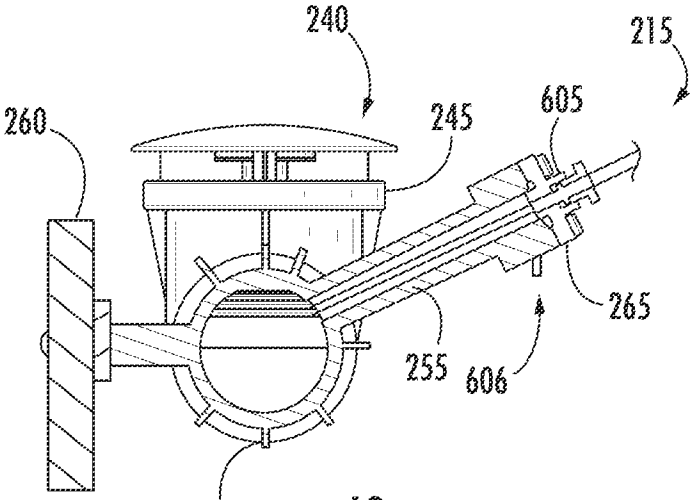
FIG. 68 shows a front view of a drain cover assembly, an inlet body valve, and connecting parts of the drain system of FIG. 67 near the bathtub exit drain, according to an exemplary embodiment.
Figure 69:
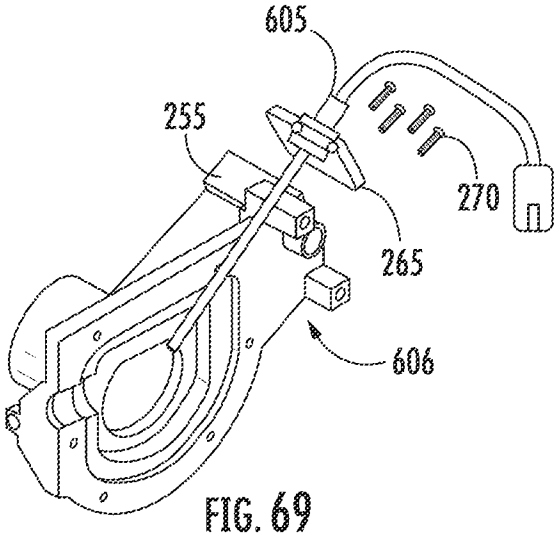
FIG. 69 shows a perspective view of an inlet valve body and coupled thermistor of the drain system of FIG. 67, according to an exemplary embodiment.
Figure 67:
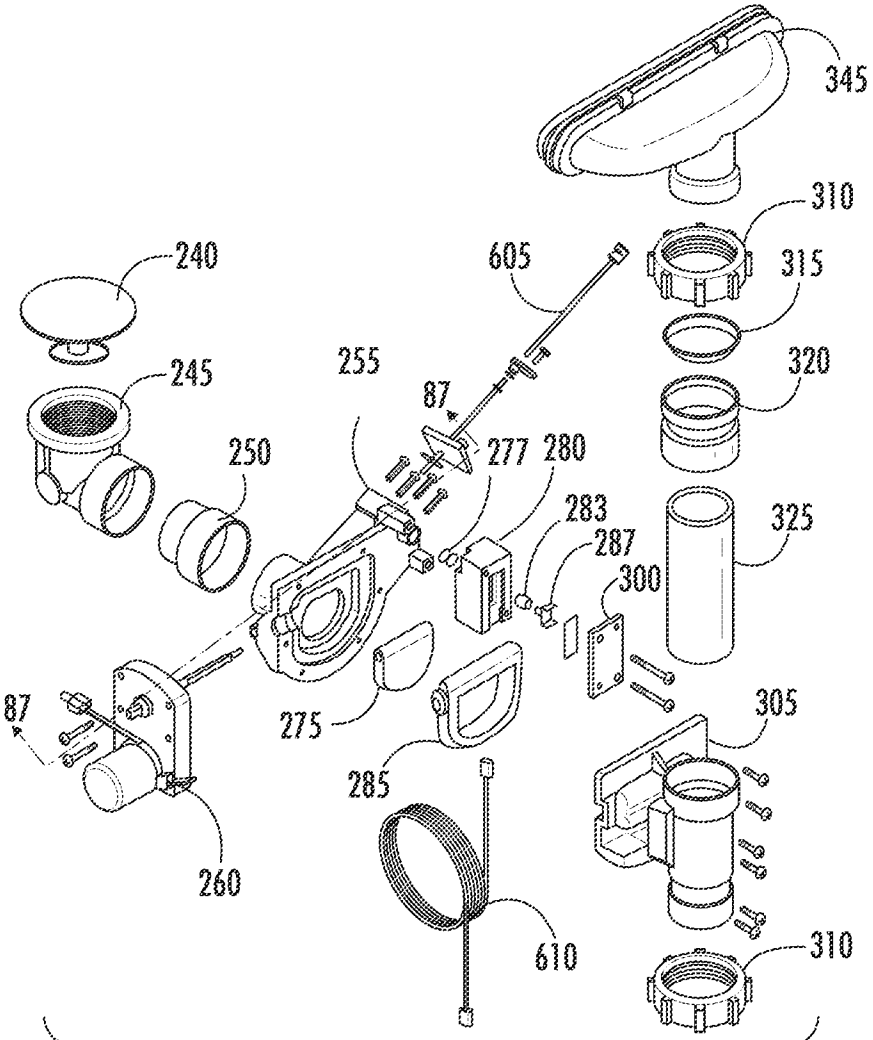
FIG. 67 shows an exploded view of a drain system, according to an exemplary embodiment.

FIGS. 67-68 show system 215 including thermistor 605 coupled to inlet valve body 255, according to an exemplary embodiment. Thermistor 605 enables temperature measurements and bath water monitoring to inform system 215 operation. As shown in FIG. 67, which is an exploded view of the system 215, the thermistor 605 may be coupled to the system 215 via the inlet valve body 255 disposed between the elbow drain 245 and the valve 275. In various embodiments, the thermistor 605 may be communicably coupled to one or more controllers and/or one or more user devices such that the thermistor 605 may be used to monitor and/or control a temperature of water entering the bathtub 210. In various embodiments, such temperature control may be based on one or more preset modes, conditions, settings (e.g., set by a controller and/or user device). As shown in FIGS. 68-69, the thermistor 605 may be coupled to the inlet valve body 255 through an opening in the air passage cover 265 such that an end of the thermistor 605 extends through an elongated portion 606 of the inlet valve body 255. In various embodiments, the thermistor 605 may facilitate the determination and setting of water temperature preferences within the bathtub 210, as defined or input by a user device, which may be communicably coupled to the thermistor 605.

FIGS. 70-80 show sensor housing 280, which contains the pressure sensor for measuring pressure within the air passageway in inlet valve 255, according to exemplary embodiments. Sensor housing 280 includes recessed features 620 and 625, which are configured facilitate placement for coupling of the sensor housing 280 to the inlet and outlet valve bodies 255 and 305, respectively. Cutout features 623, 627, 629, and 640 facilitate engagement and coupling of the sensor housing 280 to inlet and outlet valve bodies 255 and 305 and containment of a pressure sensor (and associated connections). As shown in FIGS. 71-80, the sensor housing 280 includes a protruding feature 630, which is disposed on a side of the housing 280 opposite a side 615 in which the cutout 629 is disposed. In various embodiments, the protruding feature 630 engages with the O-rings 277 to enable fluid sealing of the coupling between the sensor 280 and the inlet valve body 255.

Figure 82:
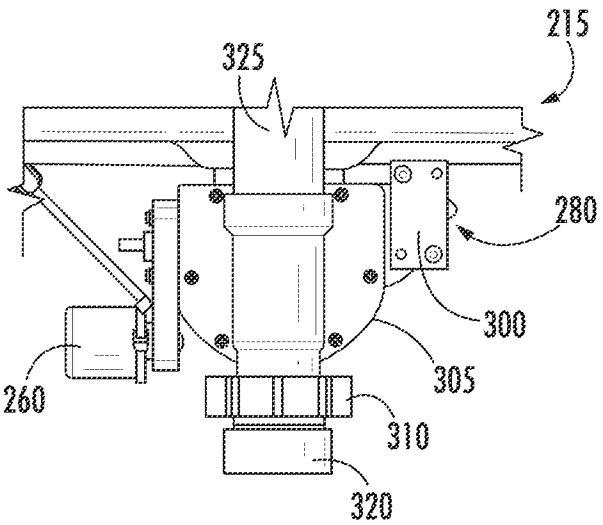
FIG. 82 is a reproduction of FIG. 81, near an outlet valve body and pressure sensor mounting block, according to an exemplary embodiment.
Figure 81:
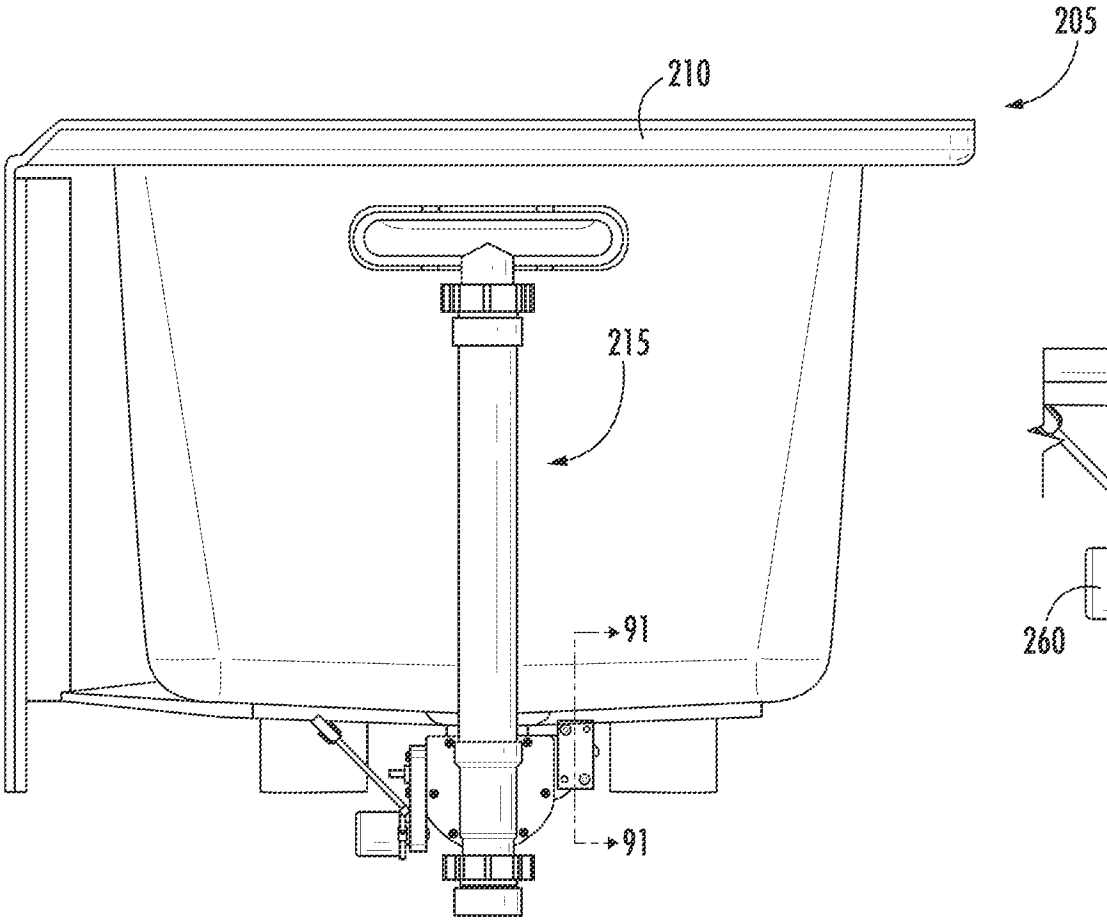
FIG. 81 shows a front view of a drain system attached to a bathtub, according to an exemplary embodiment.
Figure 85:
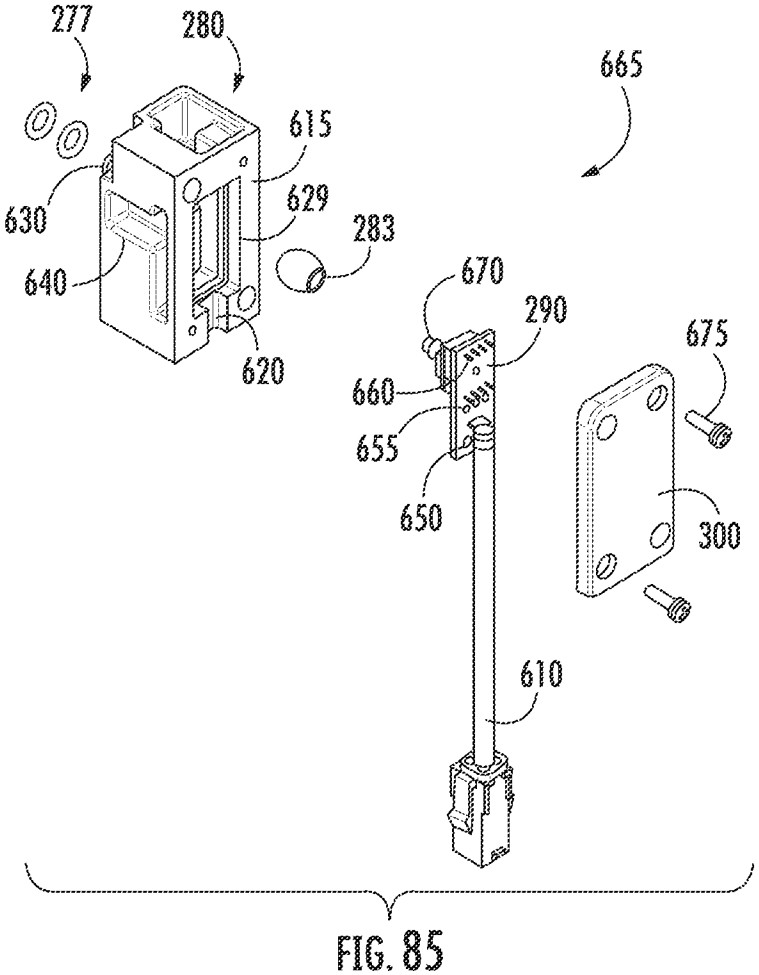
FIG. 85 is an exploded view of a pressure sensor housing assembly for a drain system, according to an exemplary embodiment.
Figure 84:
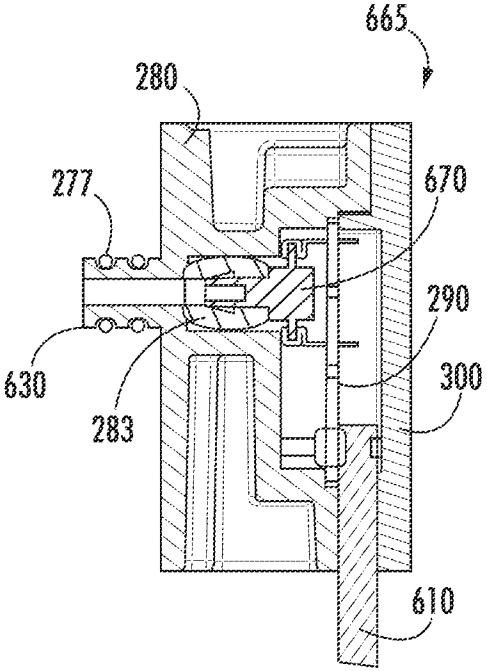
FIG. 84 is a side cross-sectional view of a pressure sensor housing assembly for a drain system taken along line 91-91 of FIG. 81, according to an exemplary embodiment.
Figure 83:
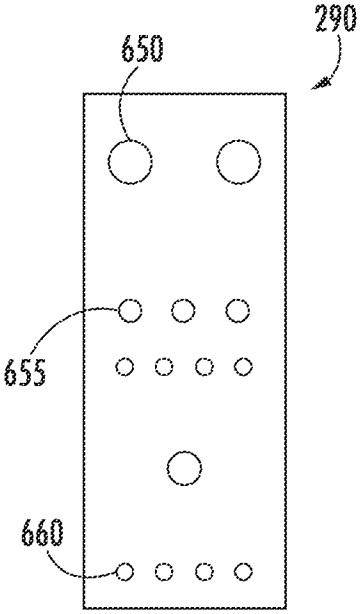
FIG. 83 is a front view of a pressure sensor circuit board for a drain system, according to an exemplary embodiment.
Figure 86:
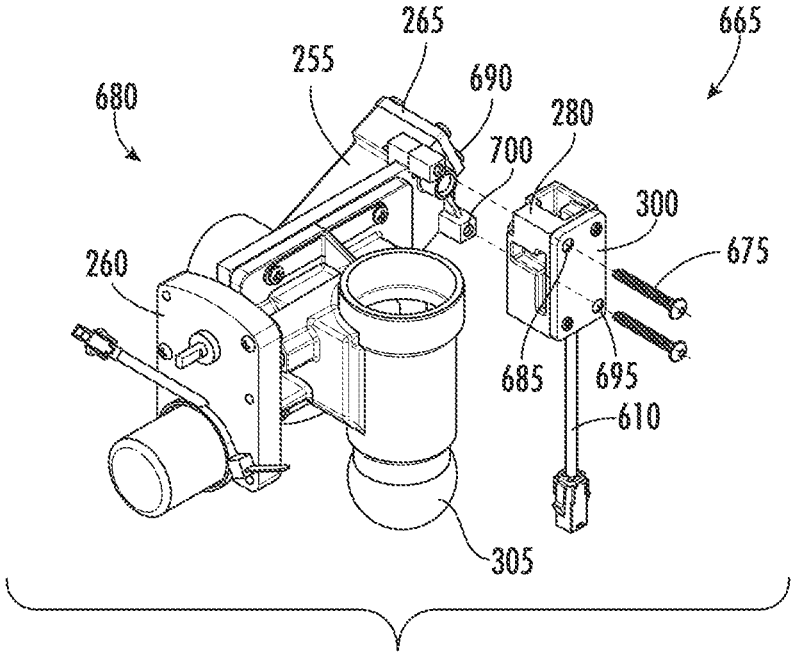
FIG. 86 is a partially exploded view of a pressure sensor and valve housing assembly for a drain system, according to an exemplary embodiment.

FIGS. 81-82 show front views of system 215 as coupled to fit the bathtub 210, according to exemplary embodiments. FIG. 82 illustrates the proximity of the motor 260 and outlet valve body 305. As described, a water level within the tub 210 may be controlled based on a pressure associated with an air bubble within inlet valve body 255, which may be measured by a pressure sensor 670. FIG. 83 shows a front view of a pressure sensor circuit board 290, which is coupled to sensor housing 280 to enable pressure measurement, in accordance with an exemplary embodiment. FIGS. 84 and 85-86 show side cross-sectional and exploded views, respectively, of pressure sensor housing assembly 665 containing pressure sensor 670, circuit board 290, and housing 280, which couples to the inlet valve body 255 via extruded member 700. As shown, the pressure sensor 670 is coupled to the pressure sensor circuit board 290 via apertures 650, 655, and 660. Pressure measured by the pressure sensor 670 may be transmitted (e.g., to a controller, a user device, etc.) via a cable 610 coupled to the pressure sensor circuit board 290. In various embodiments, the system 215 may be configured to monitor the rate of change of sensed pressure (e.g., sensed by the sensor 670) to determine normal or abnormal filling, drainage, or bathtub 210 occupancy. In various embodiments, the system 215 may be configured to operate based on one or more preset thresholds or set points corresponding to a water level (e.g., determined based on the sensed pressure), a temperature, an occupancy, etc.

Figure 87:
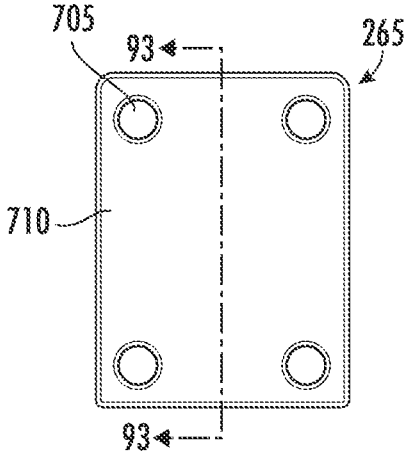
FIG. 87 is a front view of an air passage cover for the assembly of FIG. 86, according to an exemplary embodiment.
Figure 88:
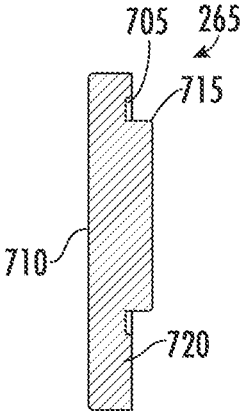
FIG. 88 is a side cross-sectional view of the air passage cover of FIG. 87 taken along line 93-93 of FIG. 87, according to an exemplary embodiment.
Figure 89:
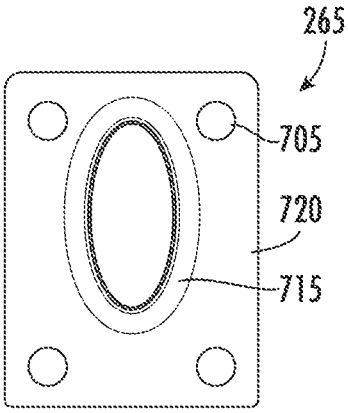
FIG. 89 is a back view of the air passage cover of FIG. 87, according to an exemplary embodiment.
Figure 92:
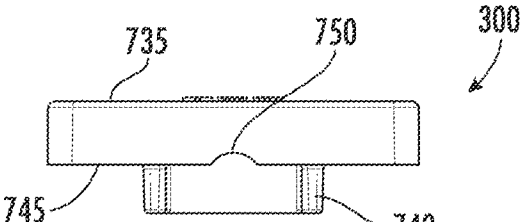
FIG. 92 is a bottom view of the pressure sensor housing cover of FIG. 90, according to an exemplary embodiment.
Figure 93:
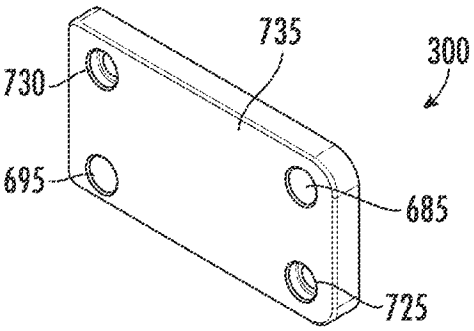
FIG. 93 is a perspective view of the pressure sensor housing cover of FIG. 90, according to an exemplary embodiment.
Figure 91:
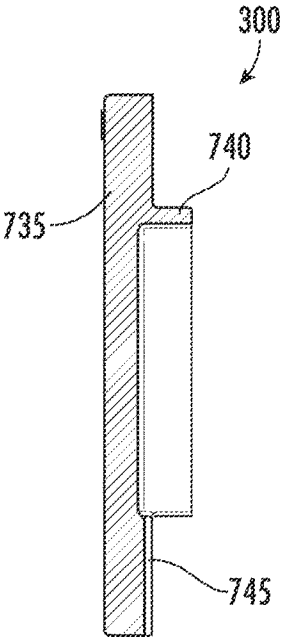
FIG. 91 is a side cross-sectional view of the pressure sensor housing cover of FIG. 90 taken along line 94-94 of FIG. 90, according to an exemplary embodiment.

FIGS. 87, 88, and 89 show front, cross-sectional, and back views of the air passage cover 265 which couples to inlet valve body 255 (via features 705-720), according to exemplary embodiments. As shown, the air passage cover 265 includes one or more apertures (e.g., through holes) 705 disposed within a first side 710 to facilitate coupling of the cover 265 to the inlet valve body 255. Furthermore, the cover 265 may further include one or more protruding portions 715, which may extend from a second side 720 to be received by one or more openings or recesses of the inlet valve body 255.

FIGS. 90-93 show a pressure sensor housing cover 300 which couples to pressure sensor housing 280 (via features 685-735), according to exemplary embodiments. As shown, the pressure sensor housing cover 300 includes apertures (e.g., through holes) 685, 695, 725, and 730 disposed within the cover 300 (e.g., within a first side 735) to facilitate coupling of the cover 300 to the pressure sensor housing 280. Furthermore, the cover 300 may further include one or more protruding portions 740 and/or recessed features 750, which may be disposed on a second side 745 of the cover 300 to be received by one or more features of the pressure sensor housing 280.

Figure 95:
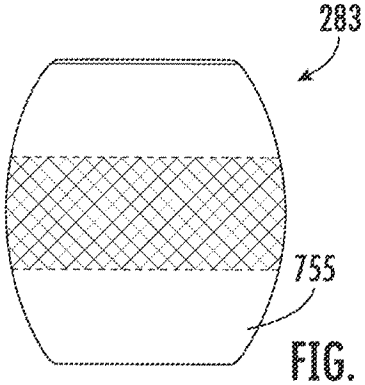
FIG. 95 is a side view of the pressure sensor seal of FIG. 94, according to an exemplary embodiment.
Figure 90:
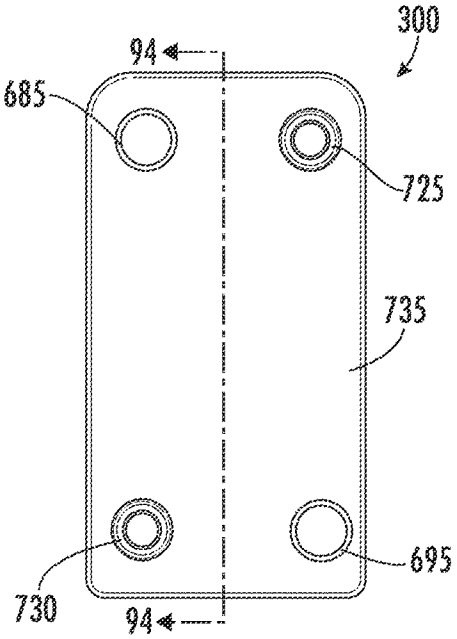
FIG. 90 is a front view of a pressure sensor housing cover for the assembly of FIG. 86, according to an exemplary embodiment.
Figure 94:
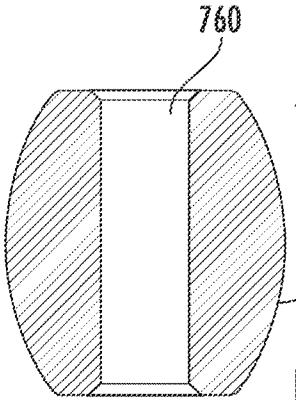
FIG. 94 is a side cross-sectional view of a pressure sensor seal for the assembly of FIG. 86 taken along line 91-91 of FIG. 81, according to an exemplary embodiment.

FIGS. 94-95 show the pressure sensor seal 283 which interfaces with a pressure sensor via an inner surface 760 and with the pressure sensor housing 280 via an outer surface 755, according to exemplary embodiments.

Figure 97:
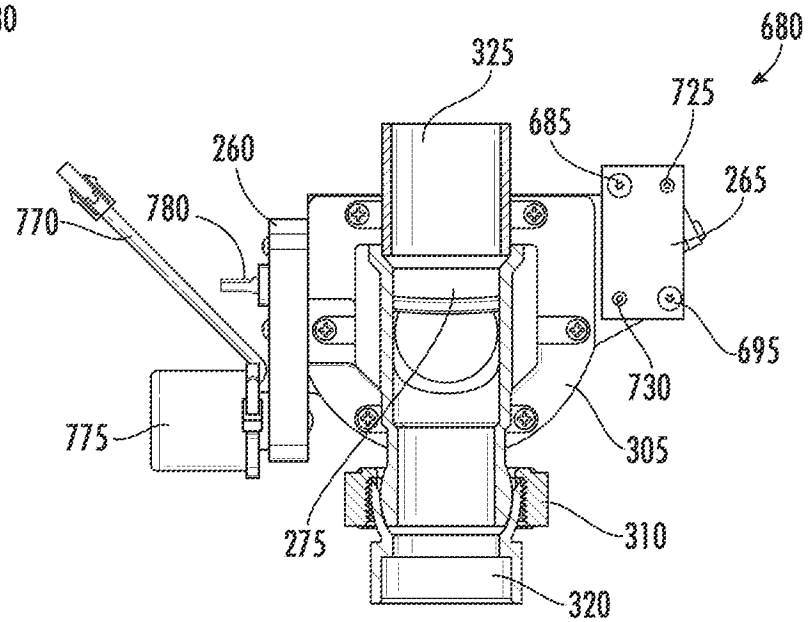
FIG. 97 is a cross-sectional view of a valve motor assembly for a drain system taken along line 77-77 of FIG. 50, according to an exemplary embodiment.
Figure 96:
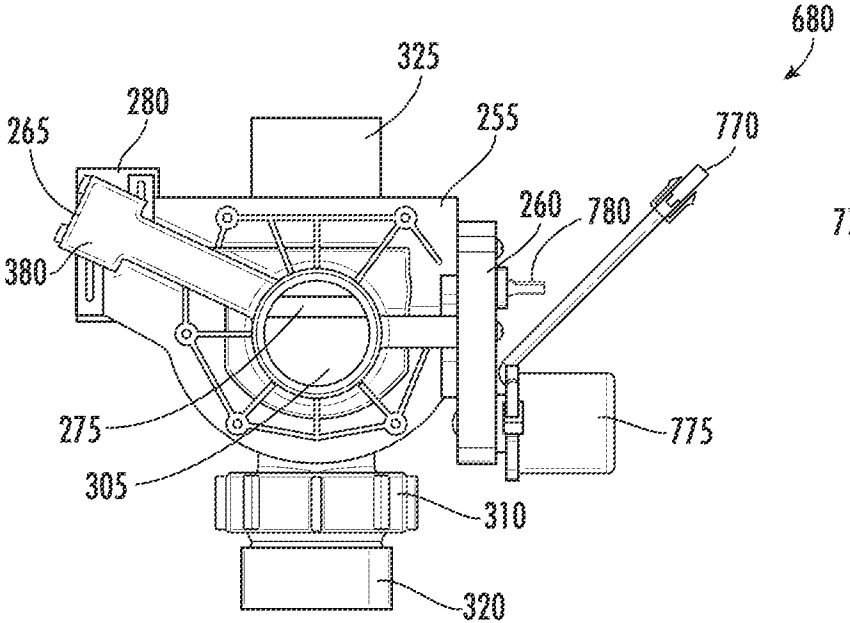
FIG. 96 is a back-end view of a valve motor assembly for a drain system, according to an exemplary embodiment.
Figure 99:
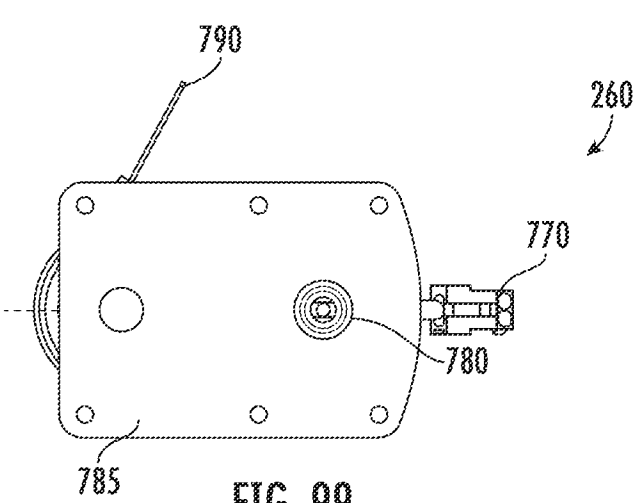
FIG. 99 is a side view of the valve motor of FIG. 98, according to an exemplary embodiment.
Figure 101:
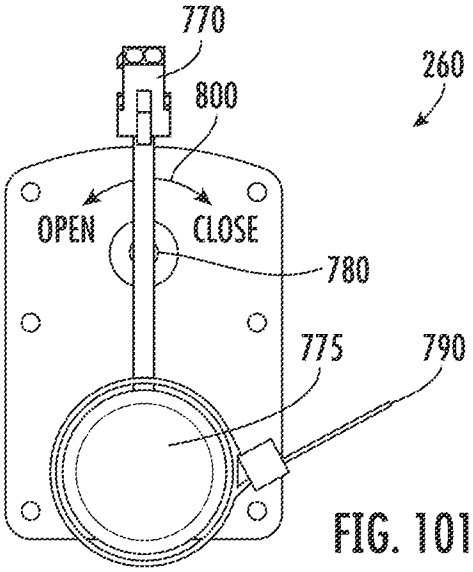
FIG. 101 is a side view of the valve motor of FIG. 98, according to an exemplary embodiment.
Figure 98:
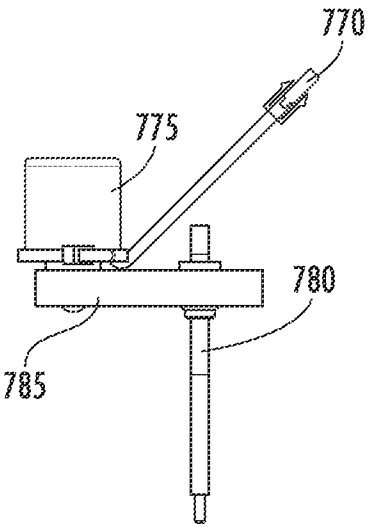
FIG. 98 is a front view of a valve motor for a drain system, according to an exemplary embodiment.
Figure 100:
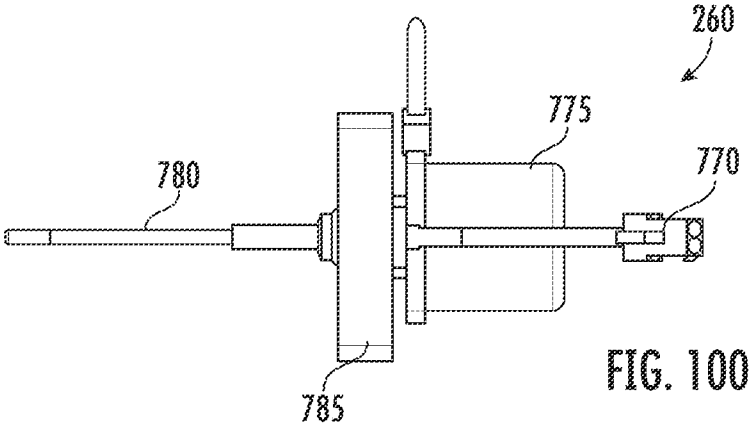
FIG. 100 is a top view of the valve motor of FIG. 98, according to an exemplary embodiment.

FIGS. 96-97 show back-end and cross-sectional views, respectively, of a valve motor assembly 680 for a drain system 215, according to an exemplary embodiment. FIGS. 96-97 illustrate connectivity among motor 260, inlet valve body 255, and outlet valve body 305. FIGS. 96-97 further illustrate a feature 770 attached to the motor 260 drive mechanism 775, adjacent a motor shaft 780, wherein the motor shaft 780 extends from the motor 260 body, which enables the motor 260 to be manually operated without electric control (e.g. "backdriven"). For example, in the event of a power failure or other situations in which the motor 260 ceases to function temporarily or permanently, a wrench may be used to move the motor shaft 780 so as to allow drainage to occur in the system. FIGS. 98-101 show side views of motor 260 to illustrate feature 770, drive mechanism 775, interfacing surface 785, motor shaft 780, portion 790 (e.g., lever, cable), and orientation direction 800, according to exemplary embodiments. Motor shaft 780 may be rotated according to the orientation direction 800 to open or close the valve 275.

Figure 103:
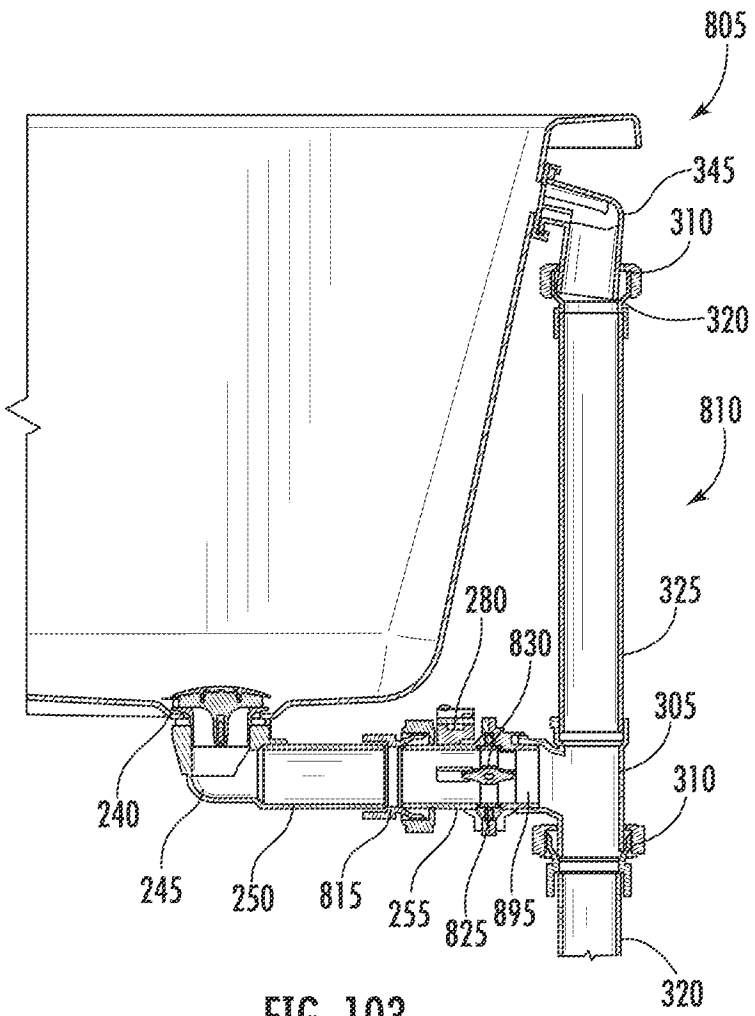
FIG. 103 is a side cross-sectional view of the drain system of FIG. 102, according to an exemplary embodiment.
Figure 102:
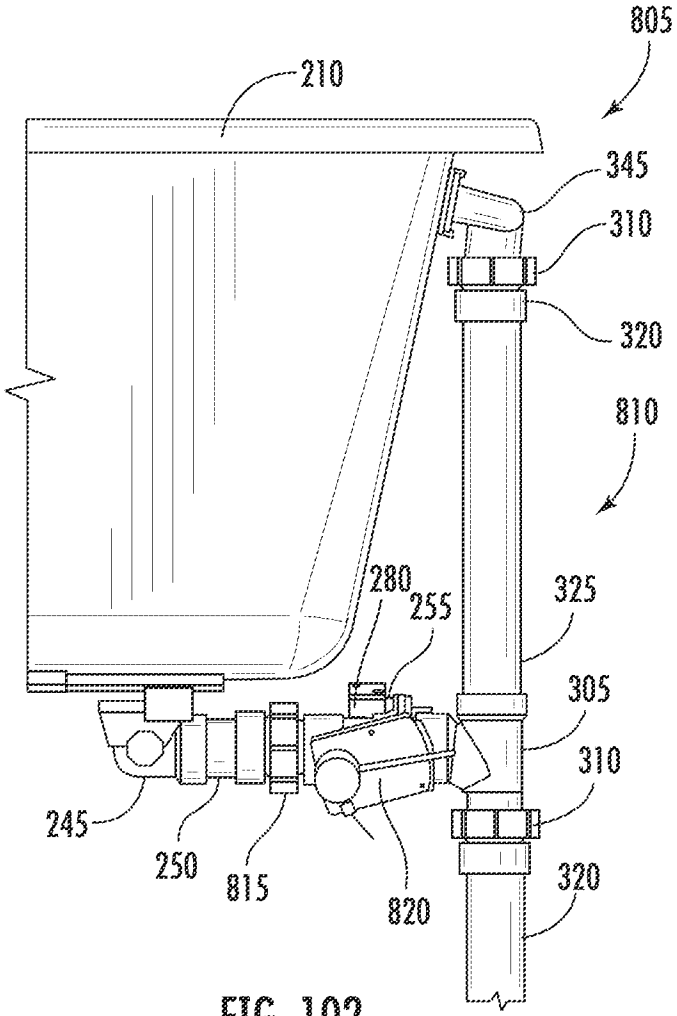
FIG. 102 is a side view of a butterfly valve design for a drain system, according to an exemplary embodiment.
Figure 104:
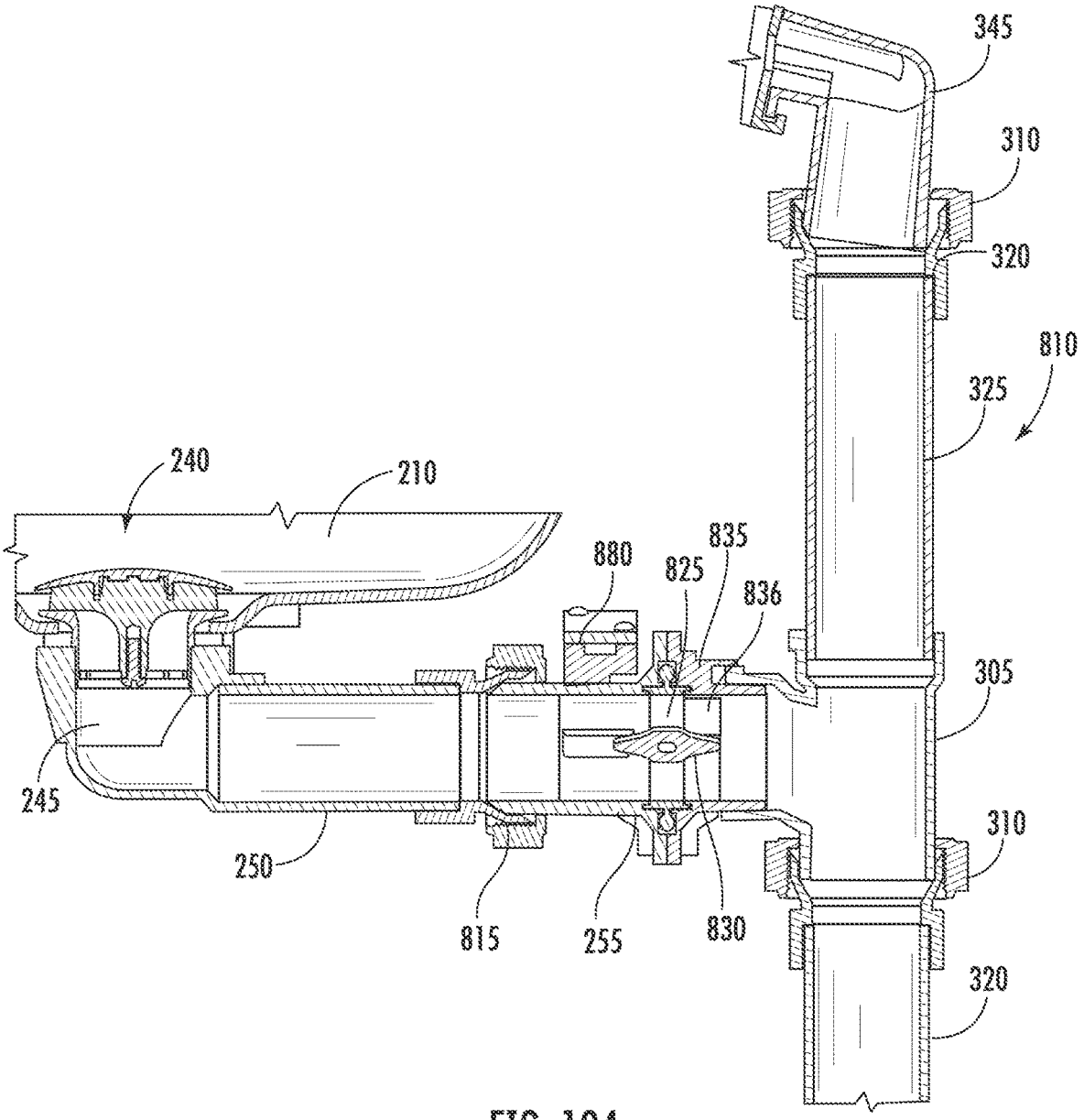
FIG. 104 is a reproduction of FIG. 103 near the butterfly valve, according to an exemplary embodiment.

FIGS. 102 and 103-104, show side and side cross-sectional views of a drain system 810 (similar to system 215) which includes a modified valve assembly 820, according to exemplary embodiments. In contrast to the previously-discussed embodiments, FIGS. 103 and 104 shows a butterfly valve 830 design housed within inlet and outlet valve bodies 255 and 835, respectively. Valve 830 interfaces with seal 825 as controlled by a motor (e.g. motor 260) to meter water flow exiting coupler 815 through system 810. According to an exemplary embodiment, valve 830 is configured as a substantially circular disk within the outlet valve body 835 and is configured to allow water to flow both over and under the valve 830 when it is in the open position as shown in FIG. 104. A stop 836 (shown as a block member just above the right-most portion of the valve 830 in FIG. 104) is provided to constrain rotation of the valve 830 further counterclockwise than shown in FIG. 104. The stop 836 is integrally formed with and extends from a wall of outlet valve body 835 in FIG. 104, but may have different sizes, shapes, or configurations according to other exemplary embodiments. As illustrated, the "fully open" position of the valve 830 is as shown in FIG. 104 such that the valve 830 is substantially parallel to the longitudinal axis of the outlet valve body 835. The "fully closed" position would be 90 degrees from that position, such that the valve 830 blocks the flow of water through the outlet valve body 835.

Figure 105:
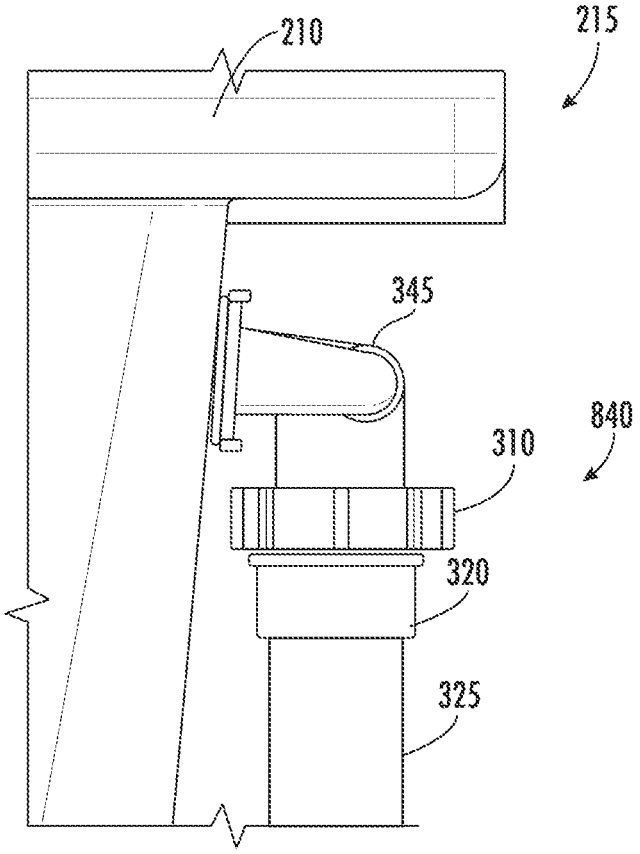
FIG. 105 is a side view of an overflow drain assembly for a drain system, according to an exemplary embodiment.
Figure 106:
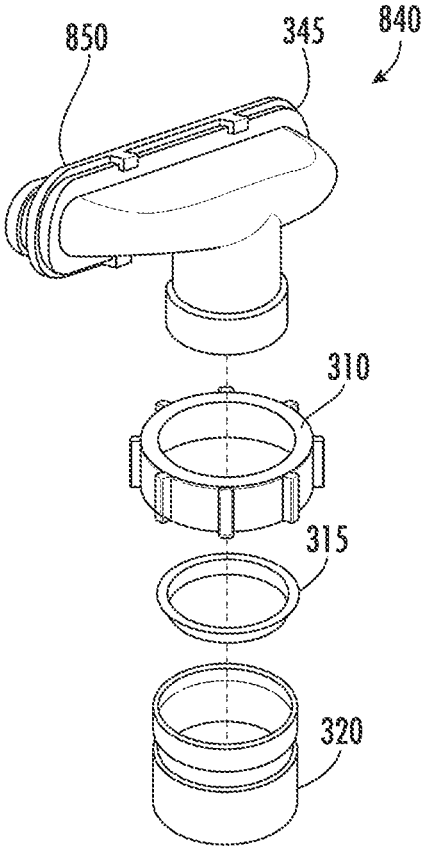
FIG. 106 is an exploded view of the overflow drain assembly of FIG. 105, according to an exemplary embodiment.

FIGS. 105 and 106 show side and exploded views, respectively, of an overflow drain assembly 840 of system 215 (or 810), according to exemplary embodiments. Assembly 840 includes an overflow elbow section 345 (located on the exterior of bathtub 210) through which water above a desired level in bathtub 210 may exit. Water flowing into section 345 subsequently flows through swivel ball fittings 310, 315, and 320 into pipe 325 to join the rest of water flow in system 215 (or 810).

Figure 107:
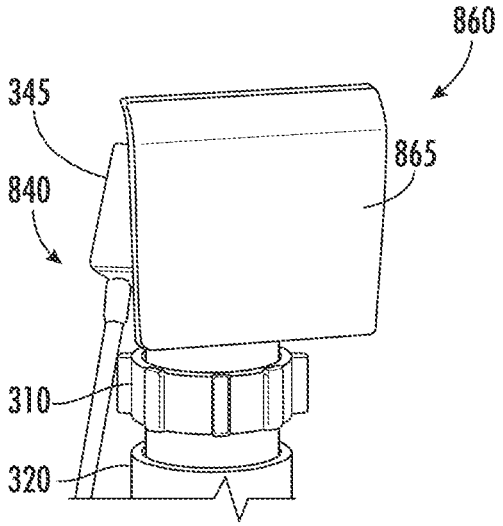
FIG. 107 is a perspective view of an overflow drain assembly with a tray-shaped cover, according to an exemplary embodiment.
Figure 108:
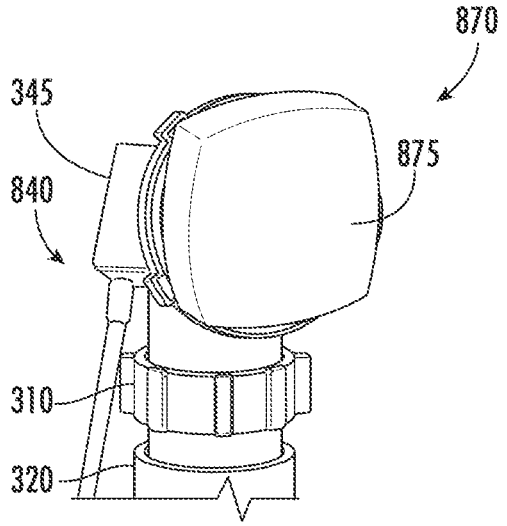
FIG. 108 is a perspective view of an overflow drain assembly with a round cover, according to an exemplary embodiment.
Figure 109:
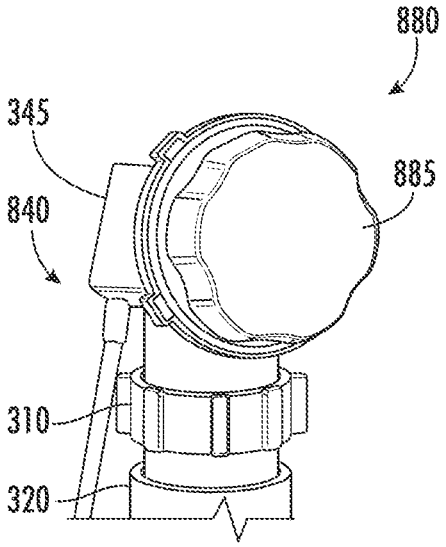
FIG. 109 is a perspective view of an overflow drain assembly with a round cover, according to another exemplary embodiment.
Figure 111:
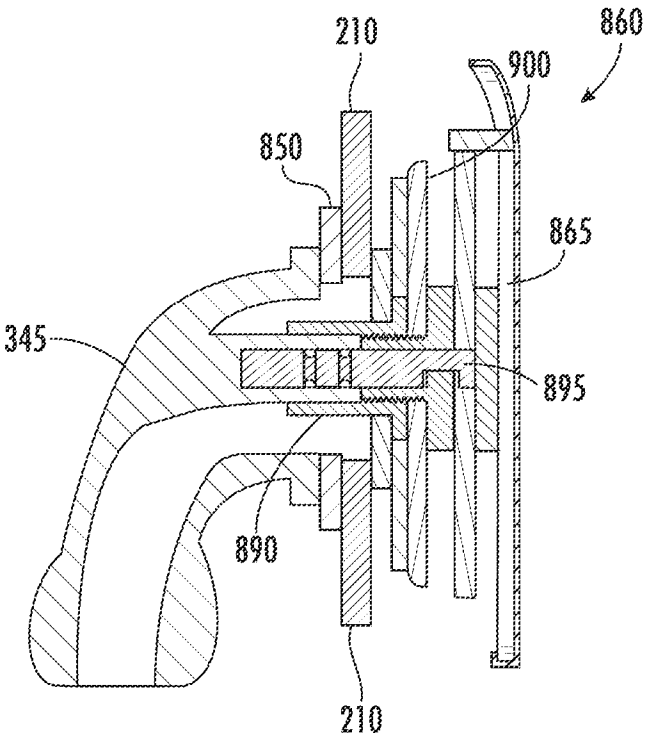
FIG. 111 is a side cross-sectional view of an overflow drain assembly with a tray-shaped cover, according to an exemplary embodiment.
Figure 110:
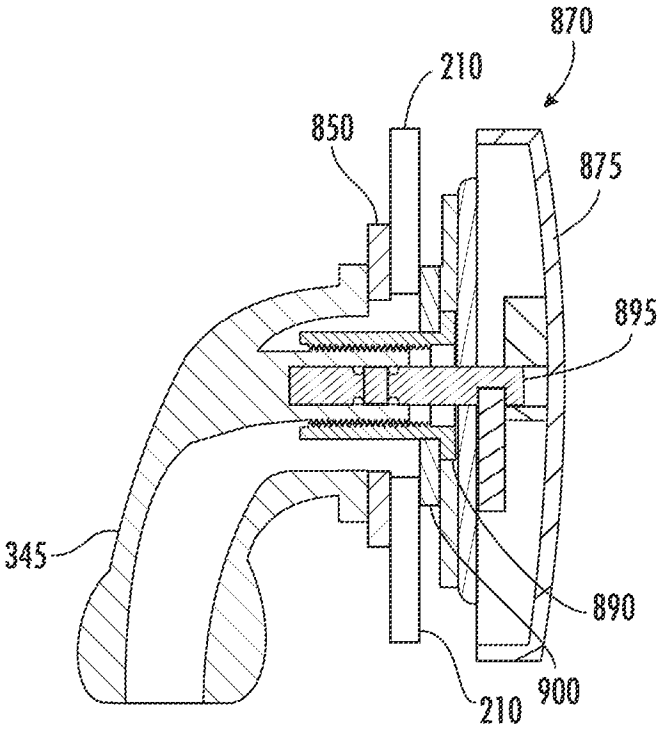
FIG. 110 is a side cross-sectional view of an overflow drain assembly with a round cover, according to an exemplary embodiment.

FIGS. 107-109 show perspective views of various overflow drain cover designs (located on interior of bathtub 210) to be coupled with assembly 840. FIGS. 107, 108, and 109 illustrate a tray-shaped cover design 860, a contoured design 870, and a round or scalloped design 880, respectively. As illustrated, the overflow drain assembly 840 may be coupled to a tray-shaped drain cover 865, a contoured cover 875, or a round or scalloped cover 885. In various embodiments, the drain covers 865, 875, 885 may be interchangeably coupled to the assembly 840. FIGS. 110-111 illustrate side cross-sectional views of the contoured design 875 and the tray-shaped design 865, respectively, according to exemplary embodiments. As shown, the elbow section 345 of the overflow drain assembly 840 may be coupled to either of covers 865, 875 via one or more coupling components 890, 895, 900. As shown, one or more sealing members 850 may be disposed between the bathtub 210 and the elbow section 345 to prevent water leakage therebetween.

Figure 116:
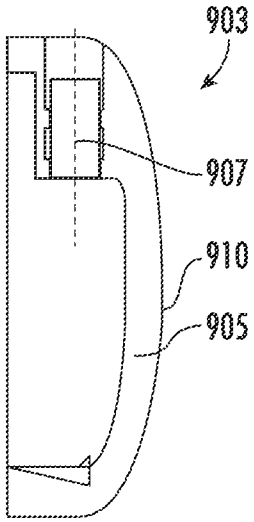
FIG. 116 is a side cross-sectional view of the drain overflow cover of FIG. 112 taken along line 93-93 of FIG. 112, according to exemplary embodiment.
Figure 115:
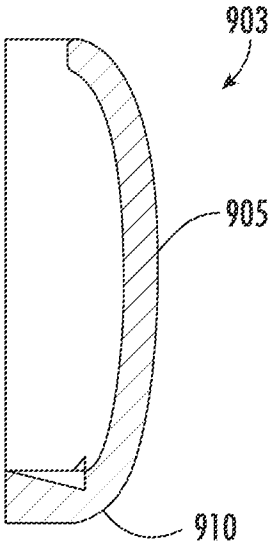
FIG. 115 is a side cross-sectional view of the drain overflow cover of FIG. 112 taken along line 92-92 of FIG. 112, according to an exemplary embodiment.
Figure 112:
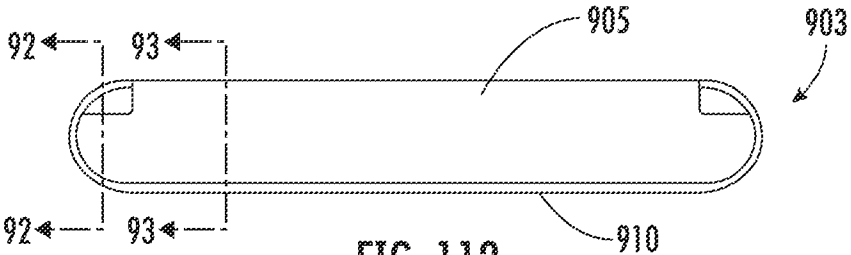
FIG. 112 is a back side view of the drain overflow cover, according to exemplary embodiments.
Figure 113:
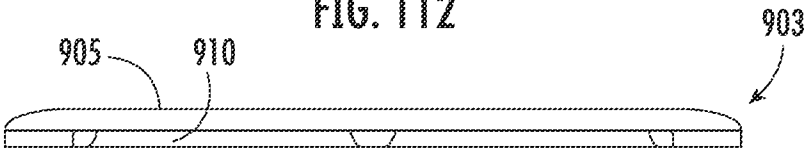
FIG. 113 is a bottom side view of the drain overflow cover of FIG. 112, according to an exemplary embodiment.
Figure 114:
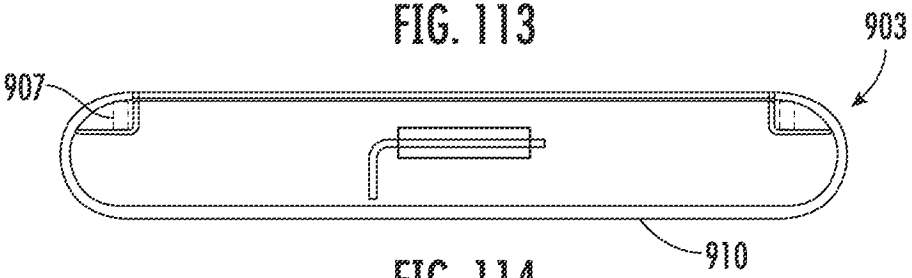
FIG. 114 is a rear view of the drain overflow cover of FIG. 112, according to an exemplary embodiment.

In yet other embodiments, the overflow drain assembly 840 may be coupled to an elongated drain cover. FIGS. 112-113 show cross-sectional (taken along lines 92-92 and 93-93, respectively) views and FIGS. 14-116 show side views of an elongated overflow drain cover 903, according to exemplary embodiments. As shown in FIGS. 114 and 115, the drain cover 903 may have a contoured body 905 with a curved outer edge 910. As shown, the cover 903 may include one or more mounting portions 907, which facilitate coupling to the overflow drain assembly 840. According to an exemplary embodiment, the overflow drain covers (e.g., covers 865, 875, 885) having different aesthetic designs may be coupled to the same "internal" portion of the overflow drain system 215 (or 810). Stated another way, the overflow drain system (e.g., system 215 or 815 via the assembly 840) may allow for the use of the same internal portion with multiple different user-facing overflow drain covers (e.g., covers 865, 875, 885), which may advantageously allow users/installers to provide a desired aesthetic appearance for the drain cover without having to change or modify the internal portion of the overflow drain system 215 (or 810).

Figure 117:
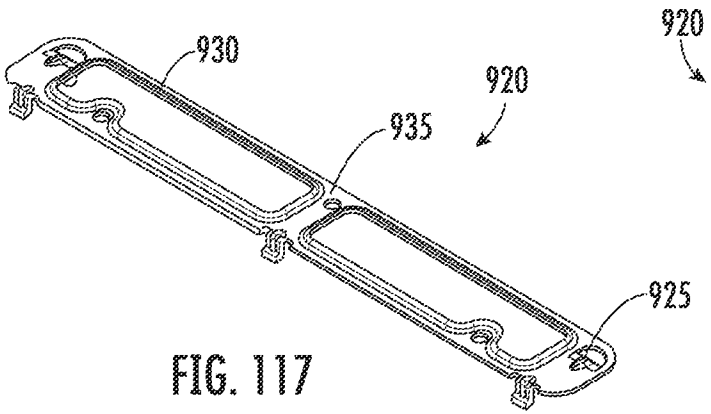
FIG. 117 is a perspective view of a mounting plate for an overflow drain assembly, according to an exemplary embodiment.
Figure 118:
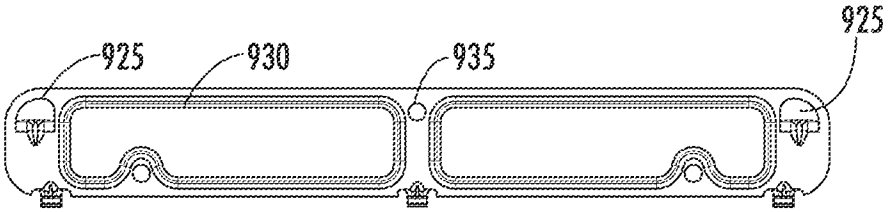
FIG. 118 is a side view of the mounting plate of FIG. 117, according to an exemplary embodiment.
Figure 121:
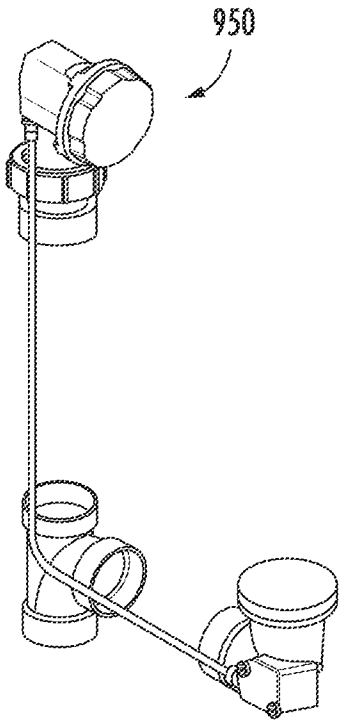
FIG. 121 is a perspective view of select components of the overflow drain assembly of FIG. 119.
Figure 120:
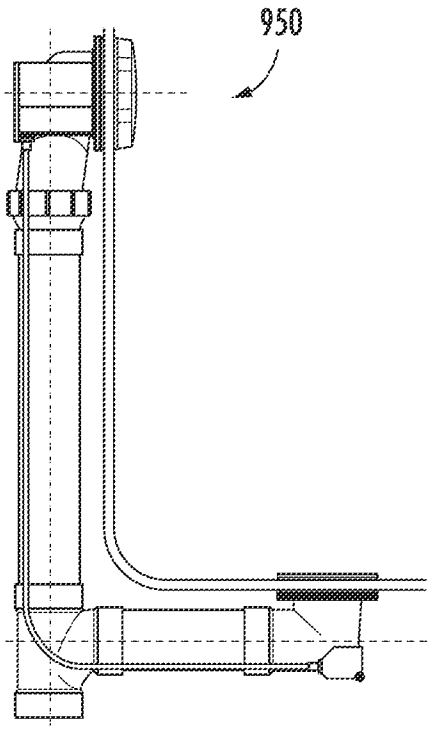
FIG. 120 is a side view of the overflow drain assembly of FIG. 119.
Figure 119:
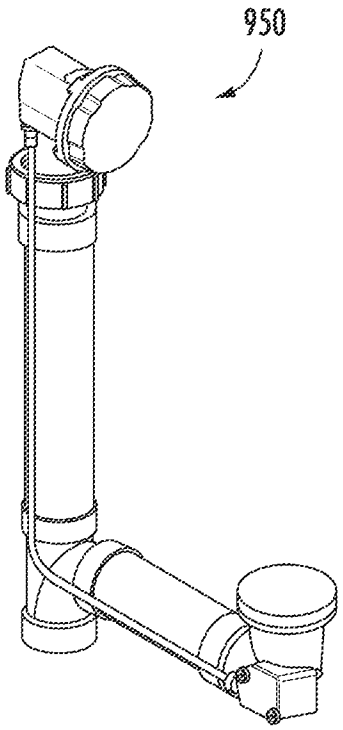
FIG. 119 a perspective view of an existing overflow drain assembly, similar to exemplary embodiments of the herein disclosure.
Figure 122:
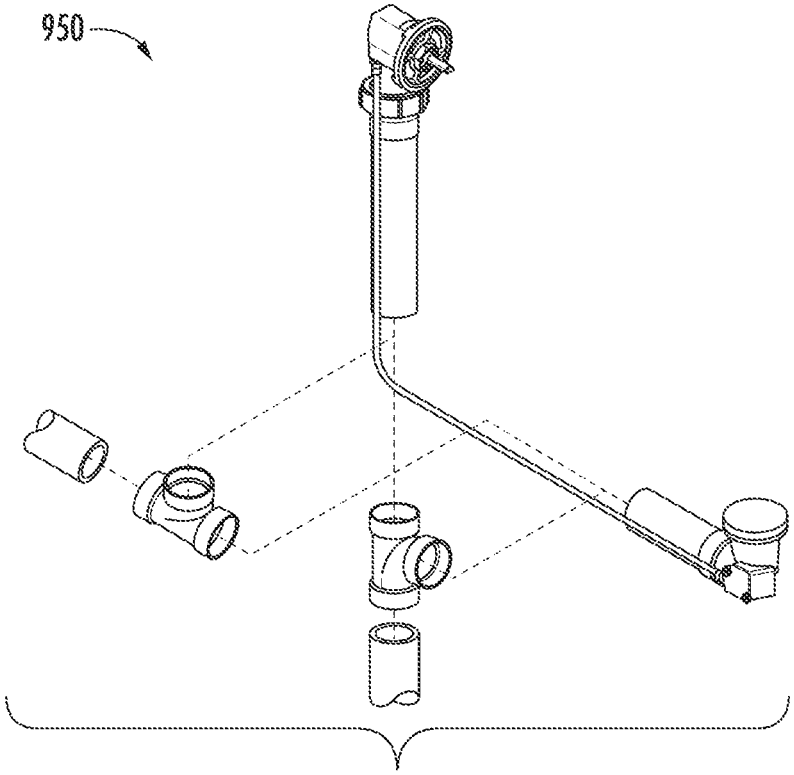
FIG. 122 is a partially exploded view of the overflow drain assembly of FIG. 119.
Figure 123:
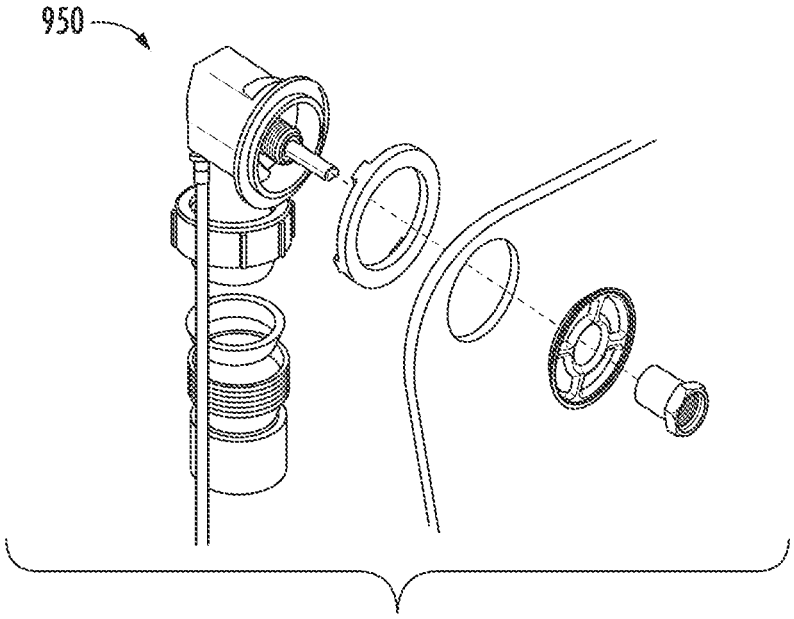
FIG. 123 is a partially exploded view of the overflow drain assembly of FIG. 119.

FIGS. 117-118 show a mounting plate 920 to couple the overflow drain cover 903 to a bathtub 210 (e.g., via assembly 840) As illustrated, the mounting plate 920 may include a contoured frame 935 having one or more mounting features or apertures 925, 925 to facilitate coupling of the plate 920 to the assembly 840. FIGS. 119-123 show various possible configurations for an overflow drain system 950 (similar or equivalent to system 215 and/or 810), according to exemplary embodiments. As shown, the overflow drain system 950 may be configured as a modular system, wherein each component within the system may be removable and/or replaceable to accommodate various tub sizes (e.g., bathtub 210), design preferences, and/or plumbing configurations. In various embodiments, the system 950 may be configured such that it may be retrofit to various tub (e.g., bathtub 210) designs.

Figure 125:
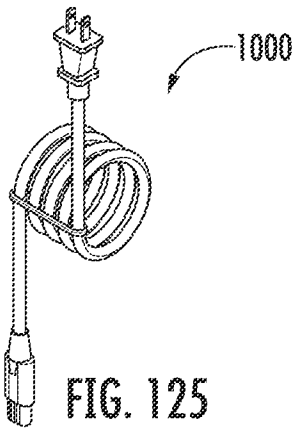
Figure 124:
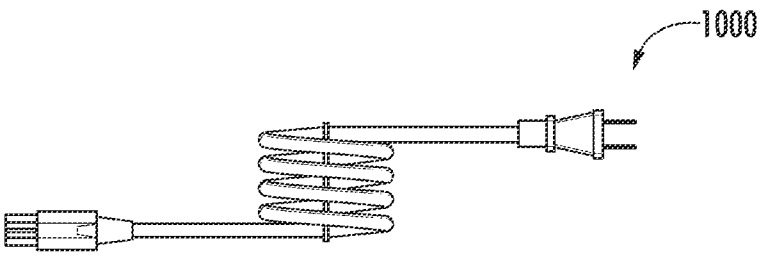
Figure 126:
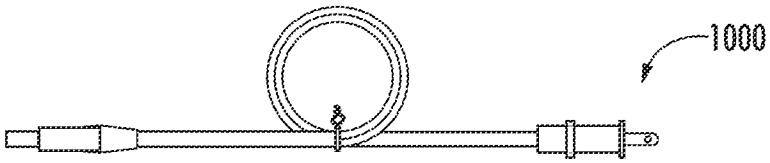

In various embodiments, the overflow drain system (e.g., system 215, 810, 950) may be couplable to one or more power supply devices to enable automatic operation of the drain system. FIGS. 124-126 show various power supply devices 1000 to enable operation of a drain system 215 (and/or systems 810, 950), according to exemplary embodiments. In various embodiments, at least one of the motor 260, pressure sensor 670, thermistor 605, or one or more controllers coupled to the system (e.g., system 215, 810, 950) may draw power via devices 1000.

Figure 127:
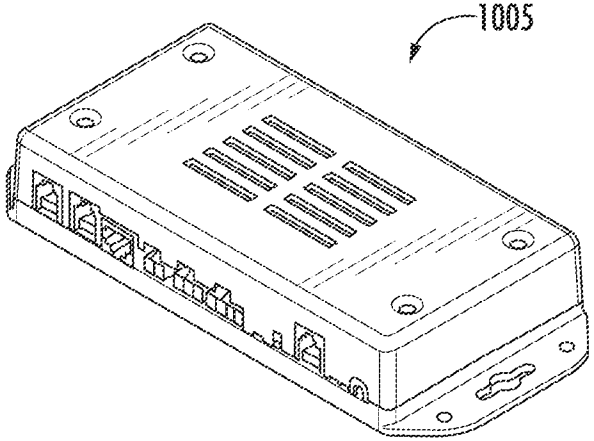

In various embodiments, the overflow drain system (e.g., system 215, 810, 950) may be couplable to a controller, such as controller 1005 as shown in FIG. 127, to control one or more operations thereof (e.g., method 100), wherein the controller may be a non-transitory computer readable medium or processor having computer-readable instructions stored thereon that when executed, cause the controller to carry out operations (e.g., operations 105-130 of method 100) called for by the instructions. In various embodiments, the controller may be a thermostat or other computing device. In yet other embodiments, the controller may be configured as part of a data cloud configured to receive commands from a user control device and/or a remote computing device. The controller may include a power source (e.g., similar or equivalent to devices 1000), a memory, a communications interface, and a processor. In other embodiments, the controller may include additional, fewer, and/or different components.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the apparatus and control system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present application. For example, any element disclosed in one embodiment may be incorporated or utilized with any other embodiment disclosed herein.

What is claimed is:

1. A drain system for a bathtub, the system comprising:

a drain exit assembly coupled to an exit drain of the bathtub, the drain exit assembly structured to receive water from the bathtub;

a valve fluidly coupled to and disposed downstream of the drain exit assembly, the valve structured to control water flow through the drain exit assembly, the valve including an air passageway configured to contain an air bubble pressurized by water in the bathtub; and a housing positioned adjacent the air passageway of the valve the housing comprising at least one sensor operably coupled to the valve and in fluid communication with the drain exit assembly;

wherein the valve is structured to control water flow through the drain exit assembly based on an input from the at least one sensor satisfying a threshold, the threshold corresponding to at least one of a temperature setpoint or a level of water within the bathtub.

2. The drain system of claim 1, wherein the at least one sensor is structured to sense at least one of a temperature or a pressure associated with the water from the bathtub.

3. The drain system of claim 2, wherein a user device is configured to receive the input from the at least one sensor.

4. The drain system of claim 3, wherein the user device is configured to determine an occupancy of the bathtub based on the rate of change.

5. The drain system of claim 3, wherein the at least one sensor is structured to sense the pressure associated with the water from the bathtub, and wherein the user device is configured to determine a rate of change of the pressure.

6. The drain system of claim 2, wherein the at least one sensor is structured to sense the pressure associated with the water from the bathtub by measuring a pressure within the air passageway.

7. The drain system of claim 1, further comprising a motor operably coupled to the valve, the motor structured to control an operational state of the valve.

8. The drain system of claim 7, further comprising a user device in communication with the motor, wherein the threshold is set by the user device.

9. The drain system of claim 1, wherein the at least one sensor comprises a first sensor and a second sensor.

10. The drain system of claim 9, wherein the first sensor is a thermistor and the second sensor is a pressure sensor.

11. The drain system of claim 1, wherein the at least one sensor is configured to sense a pressure of the water from the bathtub, and wherein the valve is coupled to an inlet valve body, the inlet valve body configured to engage with one or more recesses of the housing.

12. The drain system of claim 11, wherein the inlet valve body comprises an air pocket, and wherein the at least one sensor is further configured to sense a pressure within the air pocket.

13. The drain system of claim 1, further comprising a flow meter device fluidly coupled between the exit drain and the valve.

* * * * *